US011421563B2

(12) United States Patent
Vaseleniuck

(10) Patent No.: US 11,421,563 B2
(45) Date of Patent: Aug. 23, 2022

(54) HEAD ASSEMBLY WITH ROTATING VALVES FOR AN INTERNAL COMBUSTION ENGINE

(71) Applicant: Vaztec Engine Venture, LLC, Mooresville, NC (US)

(72) Inventor: Darrick Vaseleniuck, Mooresville, NC (US)

(73) Assignee: VAZTEC ENGINE VENTURE, LLC, Mooresville, NC (US)

( * ) Notice: Subject to any disclaimer, the term of this patent is extended or adjusted under 35 U.S.C. 154(b) by 0 days.

(21) Appl. No.: 17/404,026

(22) Filed: Aug. 17, 2021

(65) Prior Publication Data

US 2022/0049634 A1 Feb. 17, 2022

Related U.S. Application Data

(60) Provisional application No. 63/066,772, filed on Aug. 17, 2020.

(51) Int. Cl.
*F01L 7/16* (2006.01)
*F01L 7/02* (2006.01)

(52) U.S. Cl.
CPC ..... *F01L 7/16* (2013.01); *F01L 7/026* (2013.01)

(58) Field of Classification Search
CPC ..... F01L 7/16; F01L 7/026
See application file for complete search history.

(56) References Cited

U.S. PATENT DOCUMENTS

| | | | | |
|---|---|---|---|---|
| 1,200,245 | A | 10/1916 | Sevel | |
| 3,263,912 | A | 8/1966 | Frenzel | |
| 4,949,686 | A | 8/1990 | Brusutti | |
| 5,255,645 | A * | 10/1993 | Templeton | F01L 7/022 123/190.17 |
| 6,789,516 | B2 | 9/2004 | Coates | |
| 7,401,587 | B2 | 7/2008 | Donald et al. | |
| 8,714,130 | B2 | 5/2014 | Mavinahally et al. | |
| 2013/0087117 | A1 | 4/2013 | Vaseleniuck et al. | |
| 2019/0078532 | A1 * | 3/2019 | Vaseleniuck | F01L 7/16 |

OTHER PUBLICATIONS

International Search Report and Written Opinion of related PCT Application No. PCT/US21/46243 dated Nov. 29, 2021.

* cited by examiner

*Primary Examiner* — Jacob M Amick
*Assistant Examiner* — Charles J Brauch
(74) *Attorney, Agent, or Firm* — Trego, Hines & Ladenheim, PLLC; Brandon Trego

(57) ABSTRACT

A cylinder head assembly for an internal combustion engine includes: a cylinder head defining a combustion chamber and having at least one opening communicating therewith; at least one port; at least one rotatable valve element disposed between the at least one opening and the at least one port; and at least one seal assembly disposed between the at least one rotatable valve element and the cylinder head, the seal assembly comprising a seal having a concave sealing face which conforms to a peripheral surface of the at least one valve element, a labyrinth seal disposed opposite the sealing face, and a resilient secondary seal disposed between the seal and the cylinder head.

22 Claims, 22 Drawing Sheets

HEAD ASSEMBLY WITH ROTATING VALVES FOR AN INTERNAL COMBUSTION ENGINE

BACKGROUND OF THE INVENTION

This invention relates generally to internal combustion engines, and more particularly to engines using rotary valves.

Internal combustion engines are well known and are used in various applications. For example, internal combustion engines are used in automobiles, farm equipment, lawn mowers, and watercraft. Internal combustion engines also come in various sizes and configurations, such as two stroke or four stroke and with spark ignition or compression ignition.

Typically, internal combustion engines include a multitude of moving parts, for example, they include intake and exhaust valves, rocker arms, springs, camshafts, connecting rods, pistons, and a crankshaft. One of the problems with having a multitude of moving parts is that the risk of failure increases (particularly in the valve train) and efficiency decreases due to frictional losses. Special lubricants and coatings may be used to reduce friction and certain alloys may be used to prevent failure; however, even with these enhancements, the risk of failure and the frictional losses remain high. Additionally, when valve trains fail, repairing the broken valve train can be time intensive and require special tools, thereby making it very difficult to repair in the field.

Accordingly, there remains a need for a valve train for an internal combustion engine with low friction, good reliability, and a small number of parts.

BRIEF SUMMARY OF THE INVENTION

This need is addressed by a head assembly with one or more rotating valve elements.

According to one aspect of the technology described herein, a cylinder head assembly for an internal combustion engine includes: a cylinder head defining a combustion chamber and having at least one opening communicating therewith; at least one port; at least one rotatable valve element disposed between the at least one opening and the at least one port; and at least one seal assembly disposed between the at least one rotatable valve element and the cylinder head, the seal assembly comprising a seal having a concave sealing face which conforms to a peripheral surface of the at least one valve element, a labyrinth seal disposed opposite the sealing face, and a resilient secondary seal disposed between the seal and the cylinder head.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
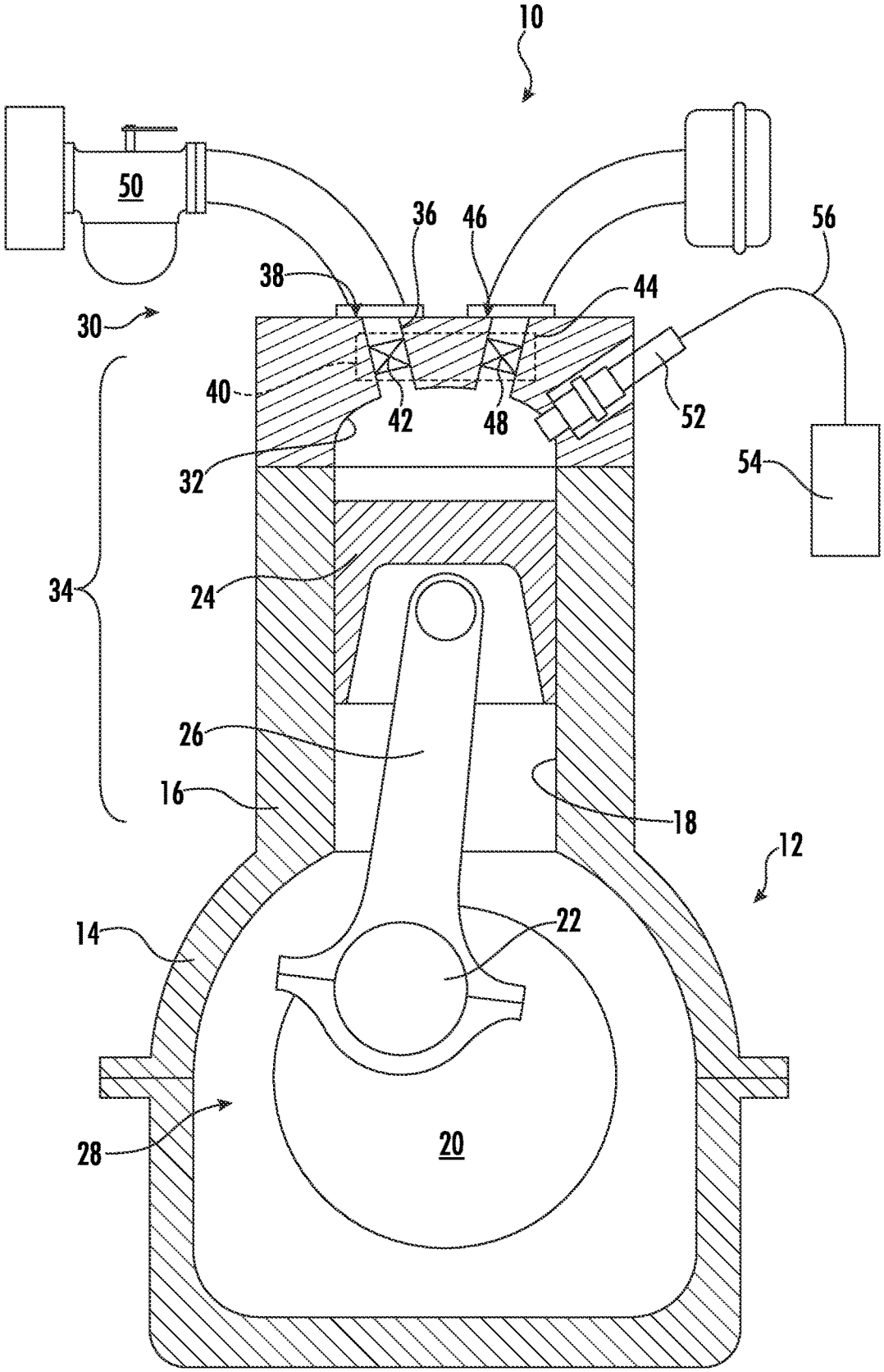
FIG. 1 is a schematic, partially-sectioned view of an internal combustion engine incorporating a head assembly with one or more rotating valves.
Figure 2:
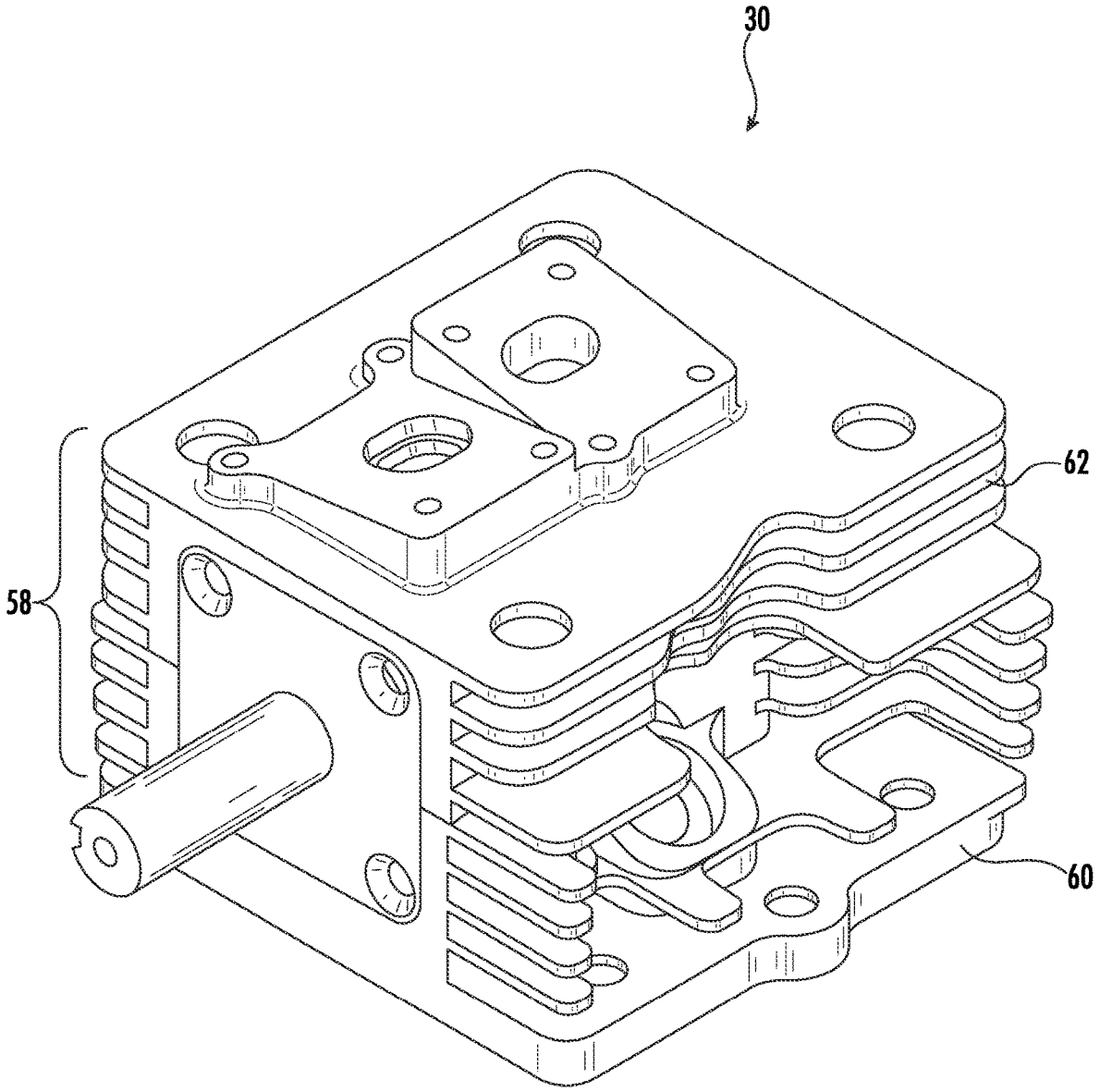
FIG. 2 is a perspective view of a head assembly with rotating valves for an internal combustion engine in accordance with an aspect of the present invention.

It will be understood that the concepts described herein may be implemented as a complete internal combustion engine, or that the cylinder head assemblies described herein may be retrofitted to an existing internal combustion engine, or that the rotating valve assembly may be incorporated into a cylinder head design. Now, referring to the drawings wherein identical reference numerals denote the same elements throughout the various views, FIG. 1 illustrates an exemplary internal combustion engine 10 constructed according to an aspect of the present invention.

The illustrated example is a single-cylinder, four-stroke engine. However, it will be understood that the principles described herein are applicable to any internal combustion engine, for example engines running various cycles such as Otto or Diesel cycles, or similar machines requiring valves to open and close fluid flow ports.

The engine includes a block 12 which serves as a structural support and mounting point for the other components of the engine 10. The block 12 includes a crankcase 14 and a cylinder barrel 16. A generally cylindrical cylinder bore 18 is formed within the cylinder barrel 16. A crankshaft 20 having an offset crankpin 22 is mounted in the block 12 for rotation in suitable bearings. A piston 24 is disposed in the cylinder bore 18, and the piston 24 is connected to the crankpin 22 by a piston rod 26. The crankshaft 20, piston rod 26, and piston 24 collectively define a rotating assembly 28. In operation, gas pressure in the cylinder bore 18 causes linear movement of the piston 24, and the rotating assembly 28 is operable in a known manner to convert linear movement of the piston to rotation of the crankshaft 20.

The engine includes a cylinder head assembly 30 attached to the cylinder barrel 16. The cylinder head assembly 30 has a generally concave combustion chamber 32 formed therein corresponding to and aligned with the cylinder bore 18. The combustion chamber 32 closes off an end of the cylinder bore 18. Collectively, the cylinder bore 18 and the combustion chamber 32 defines a cylinder 34.

The cylinder head assembly 30 has an intake port 36 formed therein. The intake port 36 extends from the combustion chamber 32 to an intake plane 38 at an exterior surface of the cylinder head assembly 30.

The cylinder head assembly 30 includes a rotary valve apparatus 40 that includes one or more rotary valve elements, which may be referred to herein as "valve barrels". A rotary intake valve element, represented symbolically at 42, is disposed across the intake port 36. It is arranged such that in a first angular orientation of the rotary intake valve element 42, fluid flow is permitted between the intake plane 38 and the combustion chamber 32, and at a second angular orientation of the rotary intake valve element 42, fluid flow is blocked between the intake plane 38 and the combustion chamber 32. As will be explained in detail below, a "rotary valve element" may refer to an independent rotating component, or a portion of a rotating component that includes multiple valve elements.

The cylinder head assembly 30 also includes an exhaust port 44 formed therein. The exhaust port 44 extends from the combustion chamber 32 to an exhaust plane 46 at an exterior surface of the cylinder head assembly 30.

The rotary valve apparatus 40 also includes a rotary exhaust valve element, represented symbolically at 48, disposed across the exhaust port 44. It is arranged such that in a first angular orientation of the rotary exhaust valve element 48, fluid flow is permitted between the exhaust plane 46 and the combustion chamber 32, and at a second angular orientation of the rotary exhaust valve element 48, fluid flow is blocked between the exhaust plane 46 and the combustion chamber 32.

The engine 10 includes a fuel delivery system 50 which is operable to receive an incoming airflow, meter a combustible fuel such as gasoline into the airflow to generate a combustible intake mixture, and deliver the intake mixture to the cylinder 34.

The fuel delivery system 50 may be continuous flow or intermittent flow, and the fuel injection point may be at the individual cylinder 34 or at an upstream location. Optionally, the fuel injection point may be within the cylinder 34, a configuration commonly referred to as "direct injection", in which case the intake port 36 would deliver only air to the cylinder 34. Known types of fuel delivery systems include carburetors, mechanical fuel injection systems, and electronic fuel injection systems. The specific example illustrated is a carburetor.

The engine 10 includes an ignition system comprising one or more spark plugs 52 mounted in each combustion chamber 32, to ignite the intake mixture. An appropriate ignition power source 54 is provided, such as a conventional Kettering ignition system with a coil and distributor, or a direct ignition system with a trigger module and separate coil, or a magneto. The ignition power source 54 is connected to the spark plug 52, for example with lead 56.

Figure 3:
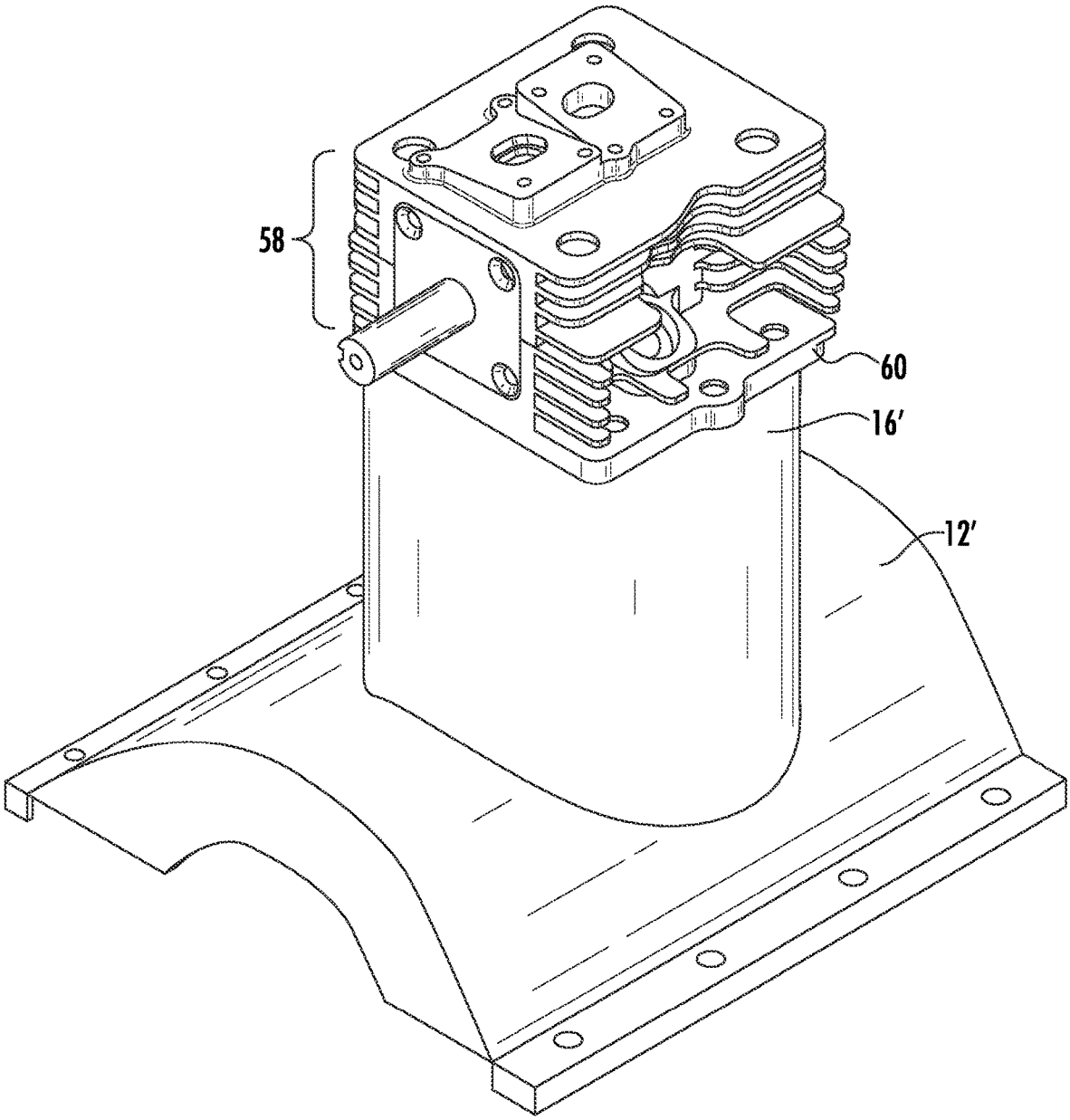
FIG. 3 is a perspective view of an alternative configuration of the head of FIG. 2.

FIGS. 2-15 illustrate the cylinder head assembly 30. The cylinder head assembly 30 includes one or more stationary components that are configured to be mounted to the engine block 12 and to enclose the operating parts. The cylinder head assembly 30 includes a cylinder head 58. In the illustrated example, the cylinder head 58 is made up of a lower section 60 attached to an upper section 62 with bolts (not shown). Alternatively, the cylinder head 58 could be made from a single part. FIG. 3 shows an optional configuration in which the lower section 60 of cylinder head 58 is made integral with a cylinder barrel 16' of an engine block 12'. Optionally, the lower section 60 of cylinder head 58 could be made integral with an individual cylinder barrel (not shown). As yet another option, the entirety of the cylinder head 58 could be made integral with a cylinder block or cylinder barrel.

Figure 4:
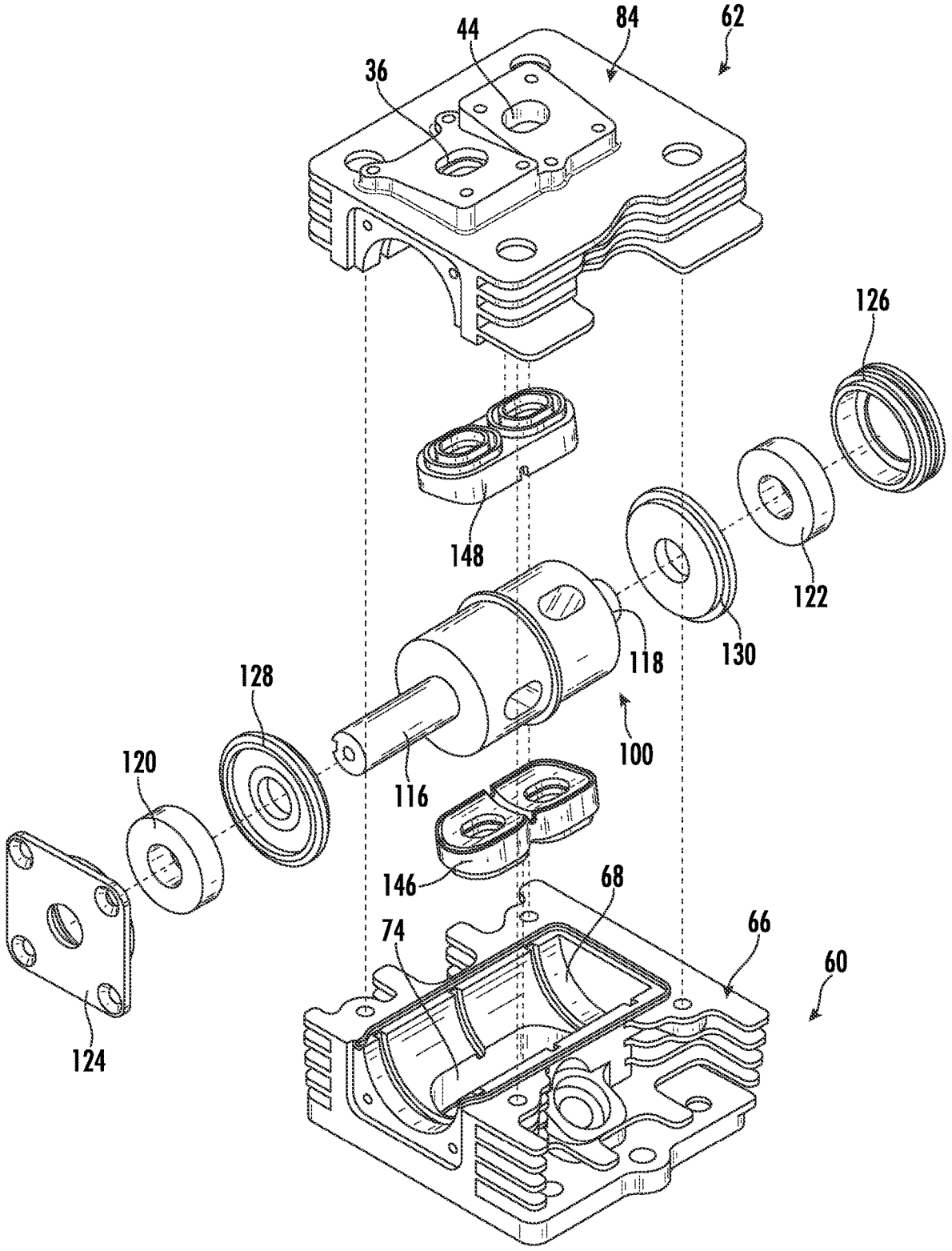
FIG. 4 is an exploded view of the head assembly of FIG. 2.
Figure 5:
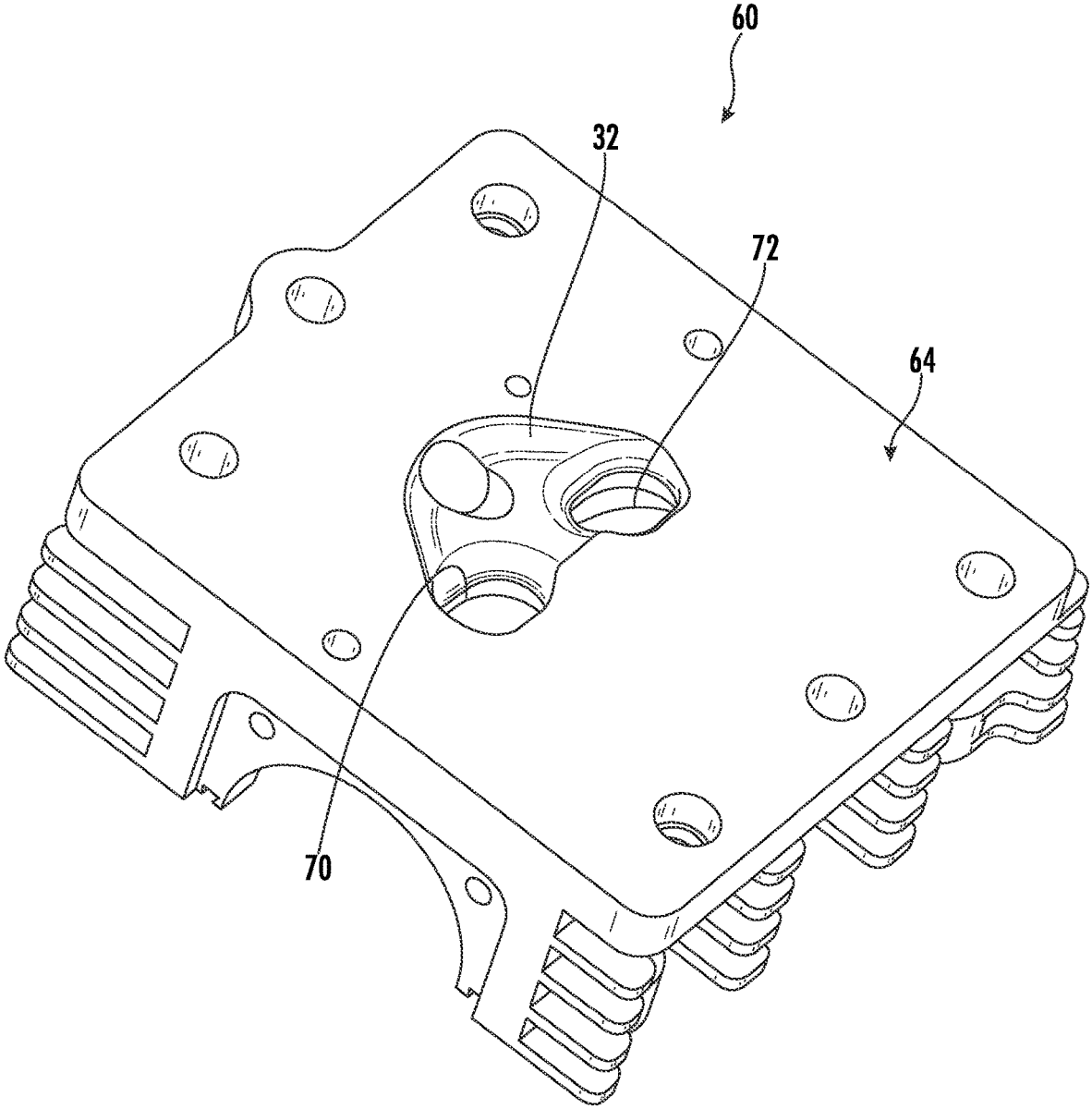
FIG. 5 is a bottom perspective view of a lower section of the head assembly of FIG. 2.
Figure 6:
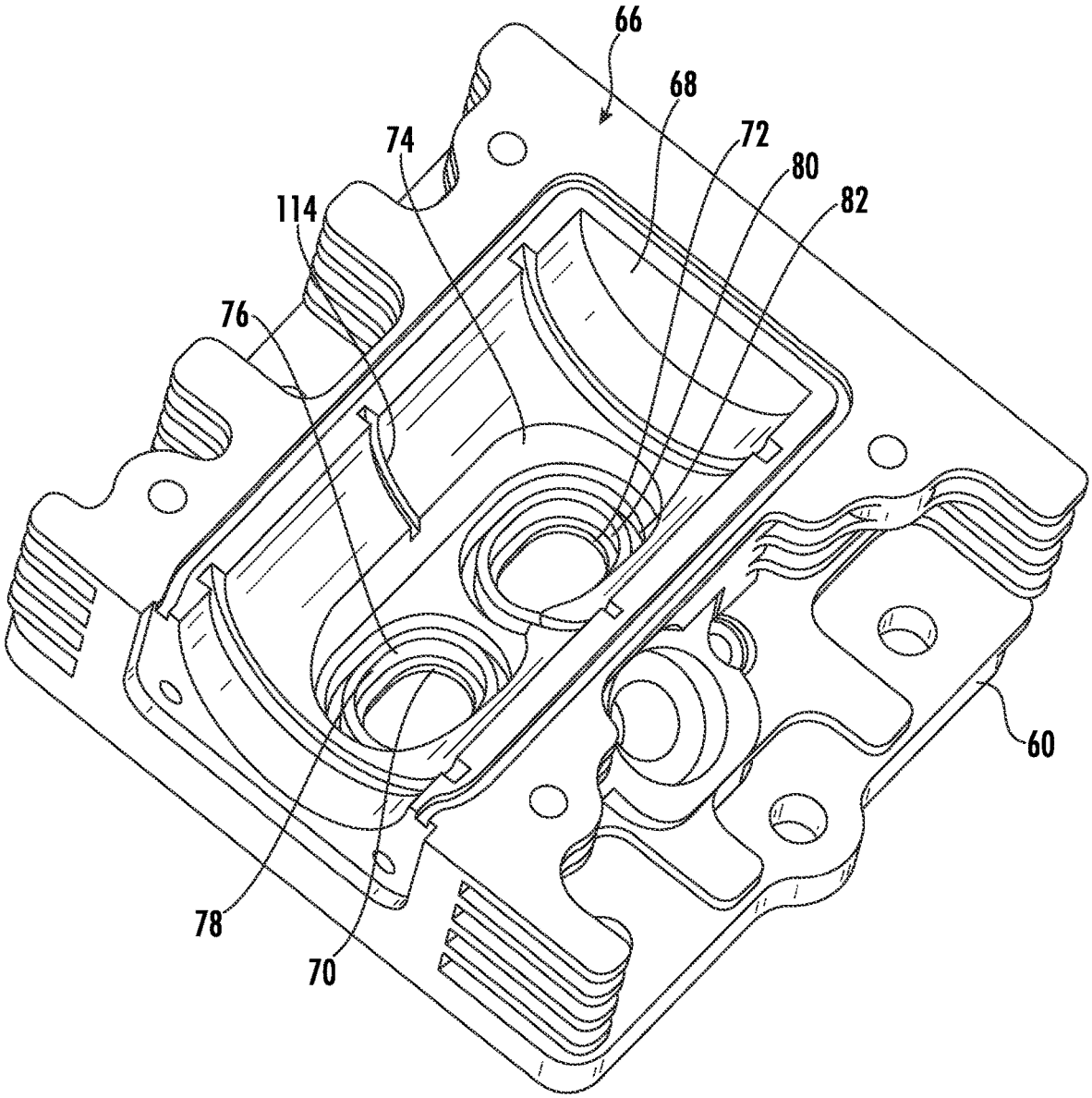
FIG. 6 is a top perspective view of a lower section of the head assembly of FIG. 2.
Figure 7:
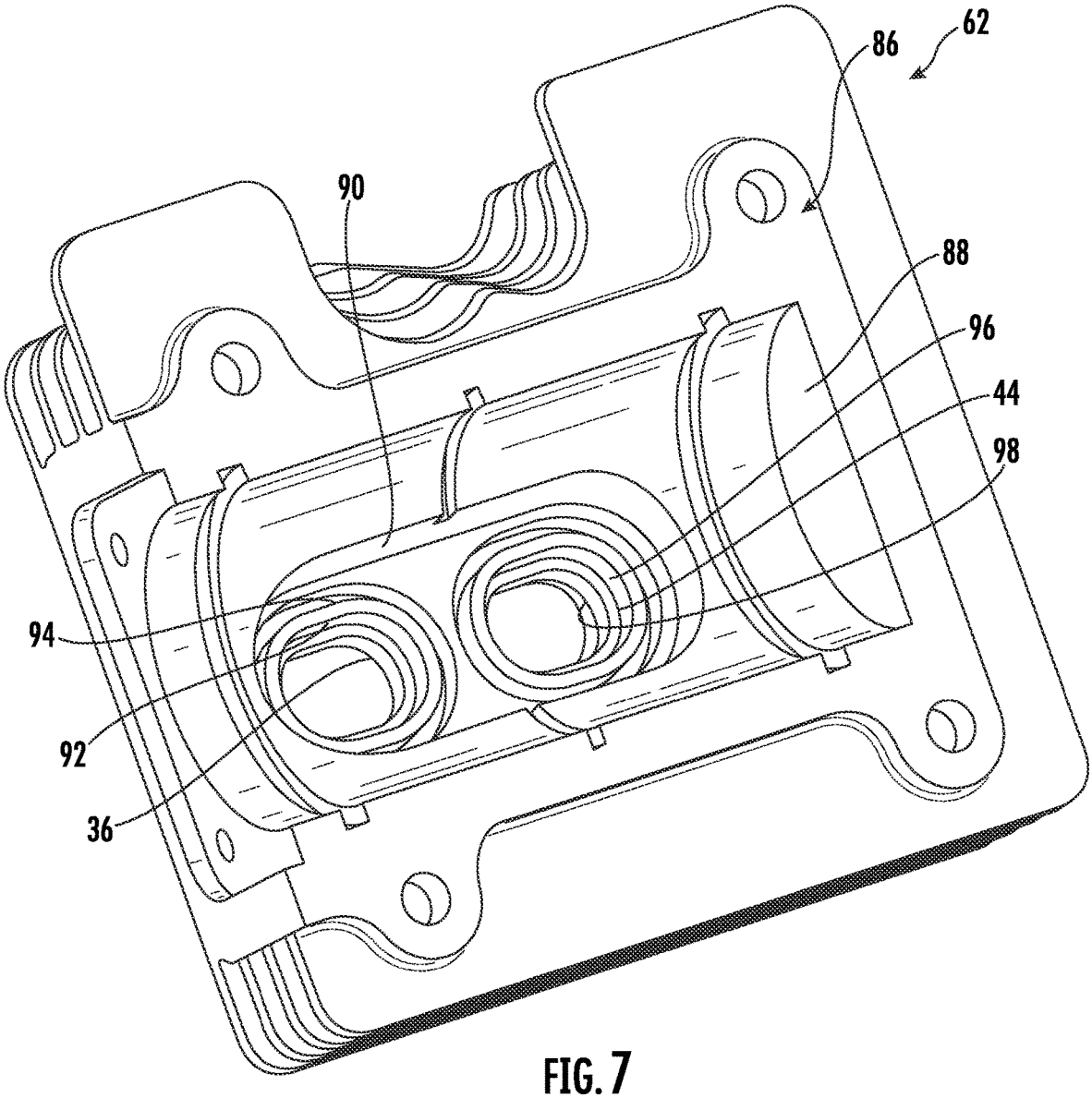
FIG. 7 is a bottom perspective view of an upper section of the head assembly of FIG. 2.

Referring now to FIG. 4, the lower section 60 is a block-like element which may be formed, for example, by casting or machining from billet. It includes an exterior surface 64 which incorporates the combustion chamber 32 (see FIG. 5), and an opposed interior surface 66 (FIG. 6). Adjacent the interior surface 66, the lower section 60 has a semi-cylindrical barrel recess 68 formed therein. The barrel recess 68 communicates with an intake opening 70 and an exhaust opening 72.

The barrel recess 68 includes a seal recess 74 surrounding the intake opening 70 and the exhaust opening 72. Within the seal recess 74, an intake tube receptacle 76 surrounds the intake opening 70. A groove-like intake seal seat 78 surrounds the intake tube receptacle 76. Similarly, an exhaust tube receptacle 80 surrounds the exhaust opening 72. A groove-like exhaust seal seat 82 surrounds the exhaust opening 72.

The upper section 62 is also a block-like element which may be formed by casting or machining from billet. It includes an exterior surface 84 (FIG. 4), and an opposed interior surface 86 (FIG. 7) which mates with the interior surface 66 of the lower section 60. The intake port 36 and exhaust port 44 described above are formed as part of the upper section 62. Adjacent the interior surface 86, the upper section 62 has a semi-cylindrical barrel recess 88 formed therein. The barrel recess 88 communicates with the intake port 36 and the exhaust port 44.

The barrel recess 88 includes a seal recess 90 surrounding the intake port 36 and the exhaust port 44. Within the seal recess 90, an intake tube receptacle 92 surrounds the intake port 36. A groove-like intake seal seat 94 surrounds the intake tube receptacle 92. Similarly, an exhaust tube receptacle 96 surrounds the exhaust port 44. A groove-like exhaust seat 98 surrounds the exhaust port 44.

When assembled, the barrel recesses 68, 88 cooperatively define a generally cylindrical barrel bore.

Figure 8:
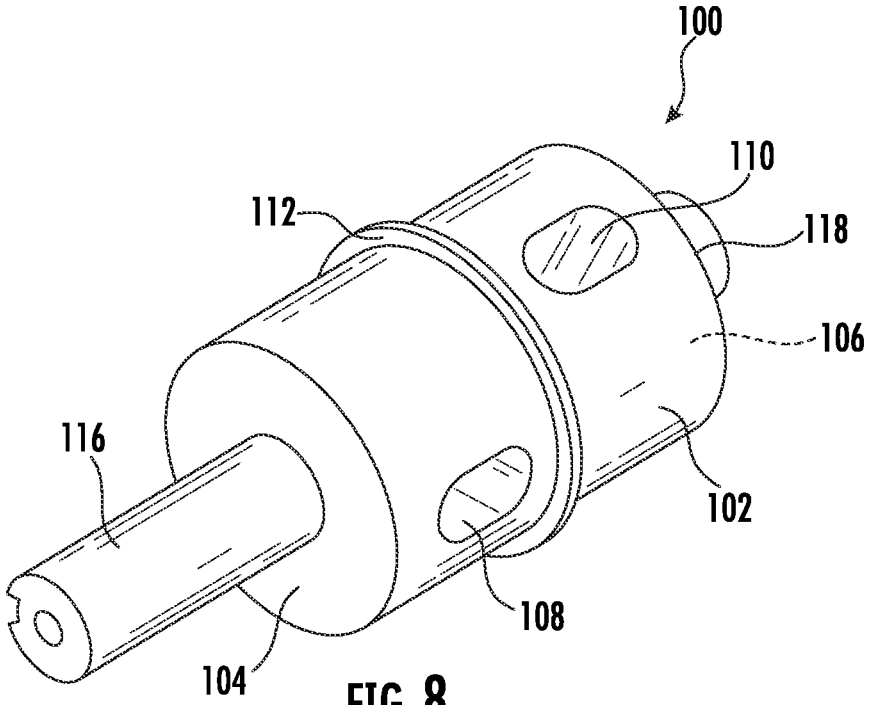
FIG. 8 is a front perspective view of a valve barrel of the head assembly of FIG. 2.
Figure 9:
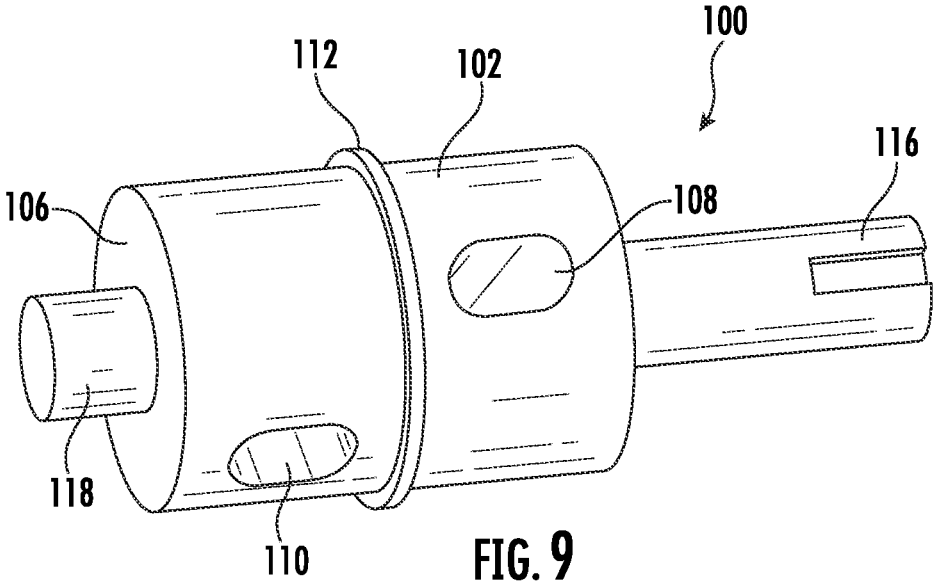
FIG. 9 is a rear perspective view of a valve barrel of the head assembly of FIG. 2.

The lower section 60 and upper section 62 receive a rotary valve element referred to herein as a valve barrel (or simply "barrel") 100. Referring to FIGS. 8 and 9, the valve barrel 100 is a generally cylindrical element with an annular peripheral surface 102 extending between forward and aft end faces 104, 106. An intake aperture 108 extends transversely through the valve barrel 100, communicating with the peripheral surface 102 on opposite sides. In some embodiments, the cross-sectional flow area of the intake aperture 108 may be constant over its length. In other iterations, chosen profiles may be used for the aperture's internal shape within the body of the valve. In the illustrated example the intake aperture 108 has an elongated "racetrack" cross-sectional shape, with two parallel sides connected by two semicircular ends. Other cross-sectional shapes may be used such as polygonal, elliptical, irregular, or some other chosen shape.

An exhaust aperture 110 extends transversely through the valve barrel 100, communicating with the peripheral surface 102 on opposite sides. In some embodiments, the cross-sectional flow area of the exhaust aperture 110 may be constant over its length. In other iterations, chosen profiles may be used for the aperture's internal shape within the body of the valve. In the illustrated example, the exhaust aperture 110 has a an elongated "racetrack" cross-sectional shape, with two parallel sides connected by two semicircular ends. Other cross-sectional shapes may be used. In other embodiments, the exhaust aperture 110 may, in plan view, have a shape chosen to fit the constraints of the cylinder head design such as polygonal, elliptical, irregular, or some other chosen shape.

Optionally, the edge between the apertures 108, 110 and the peripheral surface 102 may have a profile such as a bevel, chamfer, radius, or notch for the purpose of manipulating flow characteristics and/or changing the effective opening and/or closing point of the apertures 108, 110.

The lateral dimension of the apertures 108, 110 (perpendicular to the axis of rotation), the diameter of the valve barrel 100, and the rotational speed of the valve barrel 100 relative to the crankshaft speed all effect the valve open time or "duration", and these effects are inter-related. These variables may be manipulated in order to adapt the valve barrel 100 to suit a particular application.

The concepts described herein, in particular the sealing concepts, are applicable to other types of rotary valves incorporating flow paths that are not purely transverse relative to the valve's axis of rotation. For example. some known types of rotary valves are configured to allow fluid flow through the valve body via an opening provided at one end, the flow traveling along the axis of rotation of the valve in a chosen direction, and being in fluid communication with the combustion chamber of the engine via a peripheral opening at a chosen location on the barrel valve's outer surface, the flow being to serve as a gas exchange process for either intake or exhaust gases.

The valve barrel 100 may be made from a rigid, wear-resistant material such as a metal alloy or ceramic. Optionally, surface treatments or coatings such as carbon-based coatings or ceramics could be applied to chosen base materials for the construction of the valve barrel 100. The material selection is described in more detail below. In one non-limiting example, the valve barrel 100 is made from a steel alloy.

Figure 10:
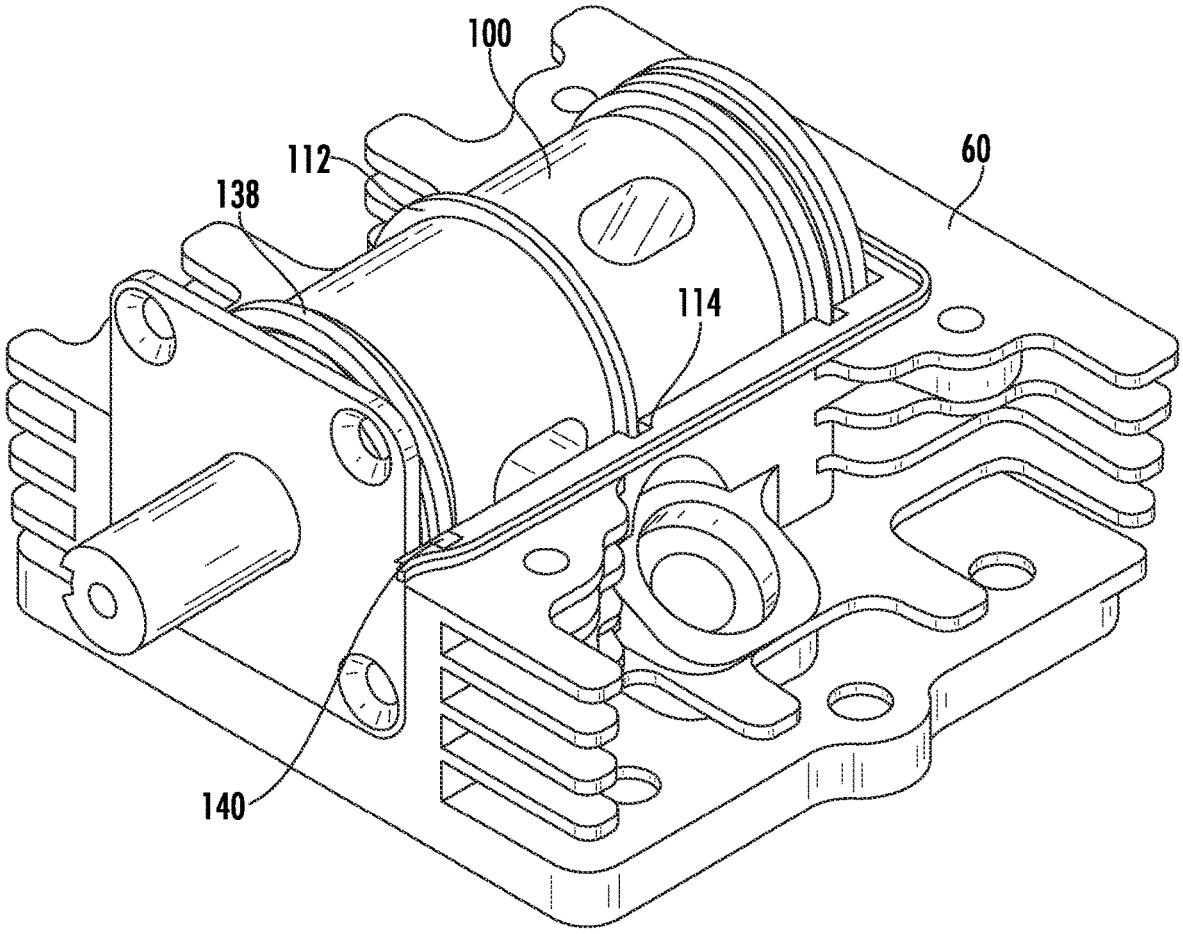
FIG. 10 is a perspective view of the head assembly of FIG. 2 with an upper section removed.

In the illustrated example, an annular flange referred to as a seal tooth 112 extends radially outward from the peripheral surface 102. As best seen in FIG. 10, when assembled, the seal tooth 112 is received in a circumferential seal groove 114 formed in the cylinder head 58, defining a non-contact rotating seal. Alternatively, the seal configuration could be inverted, i.e., the peripheral surface 102 could include a groove and the cylinder head 58 could include a seal tooth.

A forward stub shaft 116 extends from the forward end face 104, and an aft stub shaft 118 extends from the aft end face 106.

Referring to FIG. 4, the valve barrel 100 is mounted for rotation in the cylinder head 58 by a front bearing 120 that receives the forward stub shaft 116 and a rear bearing 122 that receives the aft stub shaft 118. In some embodiments, the stub shafts may be eliminated, and bearings may be mounted directly on a chosen profile of the valve's circular perimeter, or a recess provided to the valve's interior. In other embodiments, the bearings are eliminated, and the rotating barrel valve is supported solely by the seal elements 146 and 148.

In the illustrated example, the bearings 120, 122 are shown schematically as simple cylinders with central bores. Generally, any type of bearing which supports the valve barrel 100 and reduces friction may be used. Examples of suitable types of bearings include rolling element bearings (e.g., ball, roller, needle), bushings, hydrostatic bearings, or hydrodynamic bearings.

The front bearing 120 is mounted in a front cap 124 which is connected to the cylinder head 58 with suitable fasteners (not shown). The rear bearing 122 is mounted in a rear cap 126 which is received in the barrel recess 68.

The valve barrel 100 is provided with an optional front end seal 128 sandwiched between the front bearing 120 and the forward end face 104, and an optional rear end seal 130 sandwiched between the rear bearing 122 and the aft end face 106.

Figure 11:
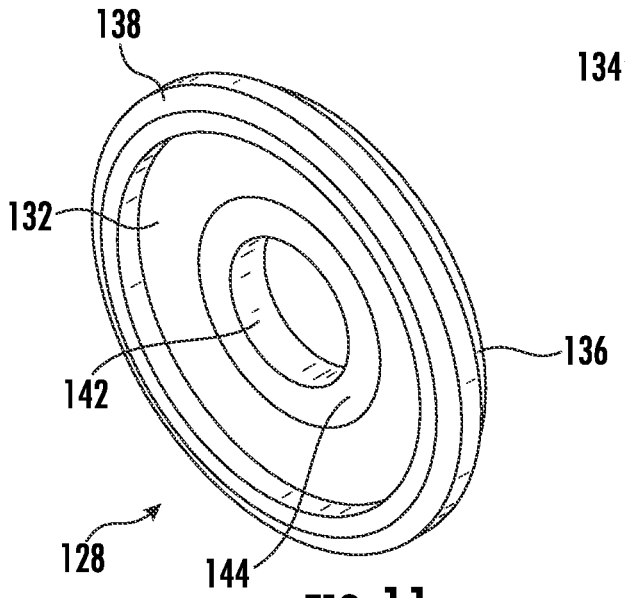
FIG. 11 is a front perspective view of an end seal of the head assembly of FIG. 2.
Figure 12:
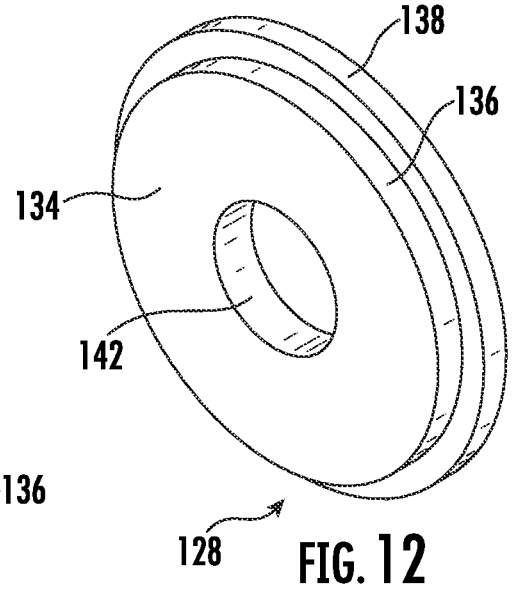
FIG. 12 is a rear perspective view of an end seal of the head assembly of FIG. 2.

The construction of the optional end seals 128, 130 is seen in more detail in FIGS. 11 and 12. The front end seal 128 is shown as an example, with the understanding that the rear end seal 130 may be identical. The front end seal 128 is generally disk-shaped, with a front face 132, a rear face 134, and an annular outer surface 136 having an outside diameter approximately the same as the outside diameter of the valve barrel 100. An annular flange referred to as a seal tooth 138 extends radially outward from the outer surface 136. As best seen in FIG. 10, when assembled, the seal tooth 138 is received in a circumferential seal groove 140 formed in the cylinder head 58, defining a non-contact rotating seal. A center hole 142 in the front end seal 128 accepts the forward stub shaft 116. A raised boss 144 is formed surrounding the center hole 142. The thickness of the boss 144 is selected such that, when assembled, the front end seal 128 is clamped between an inner race of the front bearing 120 and the forward end face 104 of the valve barrel 100, with an axial clearance present. Thus assembled, the front end seal 128 rotates with the valve barrel 100.

The end seals 128, 130 may be made from a material which is wear-resistant and/or self-lubricating. Optionally, surface treatments or coatings such as carbon-based coatings or ceramics could be provided to chosen base materials for the construction of the end seals 128, 130. One non-limiting example material is the sintered graphite form of carbon, optionally including binders or additives. Suitable carbon seal materials are commercially available.

When assembled, the valve barrel 100 is received in the barrel recesses 68 and 88, and is clamped between the lower section 60 and the upper section 62, which may be coupled together using conventional fasteners (not shown). The valve barrel 100 is then free to rotate within the cylinder head assembly 30. FIG. 10 shows the valve barrel 100 installed in the lower section 60.

As noted above and shown in FIG. 7, the barrel recess 88 of the upper section 62 communicates with intake and exhaust ports 36, 44, and the barrel recess 68 of the lower section 60 communicates with intake and exhaust openings 70, 72. Each of the sections 60, 62 incorporates a seal assembly 146, 148 respectively (FIG. 4).

Figure 13:
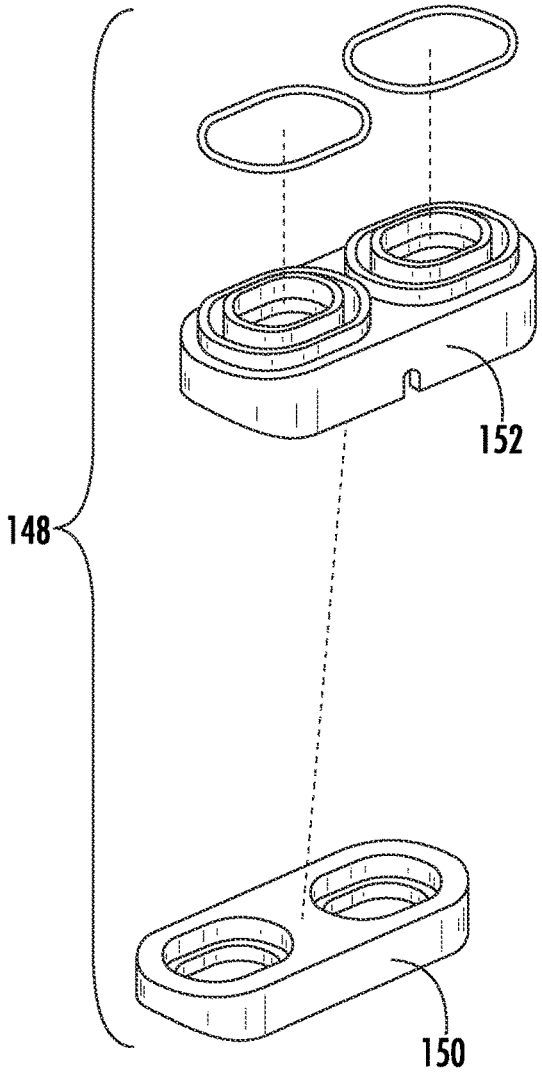
FIG. 13 is an exploded view of a seal assembly of the head assembly of FIG. 2.

The seal assembly 146 of the lower section 60 will be described with reference to FIGS. 13-15, with the understanding that this description is applicable to both of the seal assemblies 146, 148.

The seal assembly 146 is received in the seal recess 74 and operates to reduce or prevent leakage between the combustion chamber 32 and the valve barrel 100. The seal assembly 146 includes a seal 150 received in a shoe 152.

The seal assembly 148 is received in the seal recess 90 (see FIG. 7) and operates to reduce or prevent leakage between the ports 36, 44 and the valve barrel 100. The seal assembly 148 includes a seal 150 received in a shoe 152.

Figure 14:
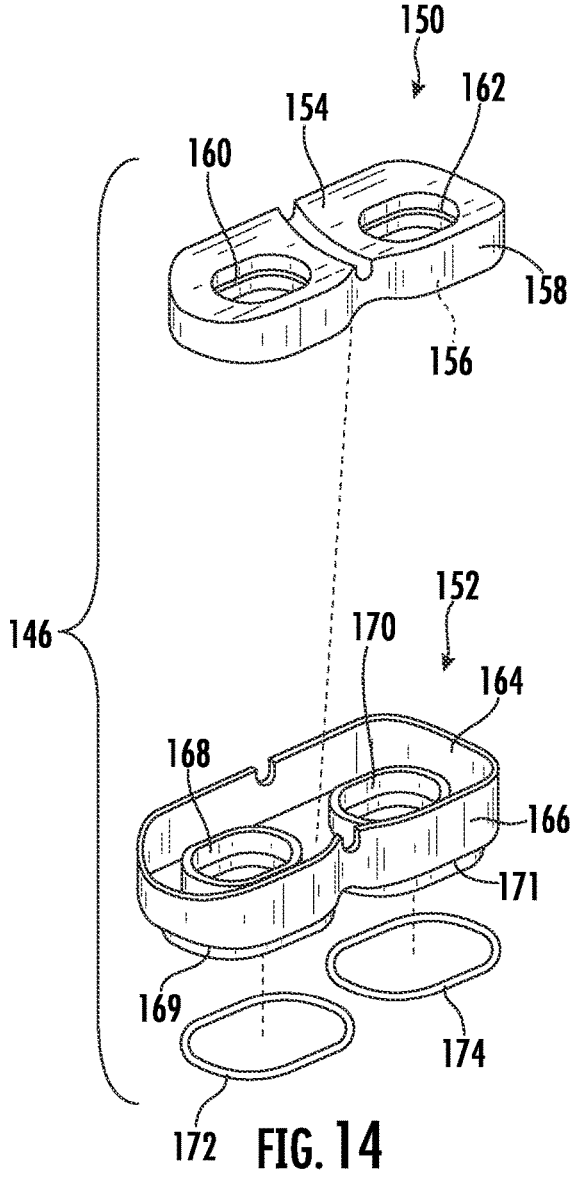
FIG. 14 is an exploded view of a seal assembly of the head assembly of FIG. 2.

The seal 150 is generally in the shape of an elongated block and includes a sealing face 154, an opposed back face 156, and a peripheral face 158 (See FIG. 14). In plan view the seal 150 has an elongated racetrack shape, with two long sides connected by semicircular ends. In other embodiments, the seal 150 may have, in plan view, another shape such as polygonal, elliptical, irregular, or some other chosen shape. The sealing face 154 has a concave curvature which matches the curvature of and conforms to the peripheral surface 102 of the valve barrel 100. An elongated intake passage 160 passes through the seal 150 from the sealing face 154 to the back face 156. An elongated exhaust passage 162 passes through the seal 150 from the sealing face 154 to the back face 156.

The seal 150 may be made from a material which is wear-resistant and/or self-lubricating. Optionally, surface treatments or coatings such as carbon-based coatings or ceramics could be applied to chosen base materials for the construction of the seal 150. The base material of the seal 150 and the valve barrel 100, and/or any coatings used, are chosen to have mutually suitable characteristics for rotating contact. In general, this requires some combination of low friction and high wear resistance. Nonlimiting examples of material pairs for this rotating contact interface include: metal/carbon, metal/ceramic, metal/bronze, ceramic/ceramic, or wear-coated metal/wear-coated metal.

As one non-limiting example, where the valve barrel 100 is steel or other metal alloy, the seal 150 may be made from a material which is wear-resistant, and preferably self-lubricating. One example of a wear-resistant, self-lubricating material is the sintered graphite form of carbon, optionally including binders or additives. Suitable carbon seal materials are commercially available.

The shoe 152 is an enclosure having an interior surface 164 complementary to the back face 156 and the peripheral face 158 of the seal 150, and an exterior surface 166 complementary to the seal recess 74 in the lower section 60. The shoe 152 includes an open intake tube 168 with a flow area generally matching, at one end, the shape and size of the intake passage 160 of the seal 150, and at its opposite end, the shape and size of the intake opening 70 in the cylinder head 58. An upstanding secondary seal flange 169 surrounds the intake tube 168. The shoe 152 also includes, spaced-apart from the intake tube 168, an open exhaust tube 170 with a flow area generally matching, at one end, the shape and size of the exhaust passage 162 of the seal 150, and at its opposite end, the shape and size of the exhaust opening 72 in the cylinder head 58. An upstanding secondary seal flange 171 surrounds the exhaust tube 170. The shoe 152 may be made from a generally rigid, durable material, such as a metal alloy.

The intake tube 168 may have a cross-sectional shape generally matching the cross-sectional shape of the intake tube receptacle 76. As best seen in FIG. 15, the intake tube 168 forms a telescoping fit with the intake tube receptacle 76.

The exhaust tube 170 may have a cross-sectional shape generally matching the cross-sectional shape of the exhaust tube receptacle 80. The exhaust tube 170 forms a telescoping fit with the exhaust tube receptacle 80.

A secondary seal 172 is disposed in the intake seal seat 78 and the secondary seal flange 169 bears against it. In some embodiments, the secondary seal is racetrack-shaped in plan view and may have a circular or polygonal cross-sectional shape. In other embodiments, the secondary seal may 172, in plan view, have a shape such as polygonal, elliptical, irregular, or some other chosen shape. The secondary seal 172 may be made from a resilient material. Examples includes metals or nonmetallic materials such as rubber, plastic, or elastomer.

A secondary seal 174 is also disposed in the exhaust seal seat 82 and the secondary seal flange 171 bears against it. The secondary seal is racetrack-shaped in plan view and may have a circular or polygonal cross-sectional shape. In other embodiments, the secondary seal may 174, in plan view, have a shape chosen to fit the constraints of the cylinder head design such as polygonal, elliptical, irregular, or some other chosen shape. It may be made from a resilient material. Examples includes metals or nonmetallic materials such as rubber, plastic, or elastomer.

Figure 15:
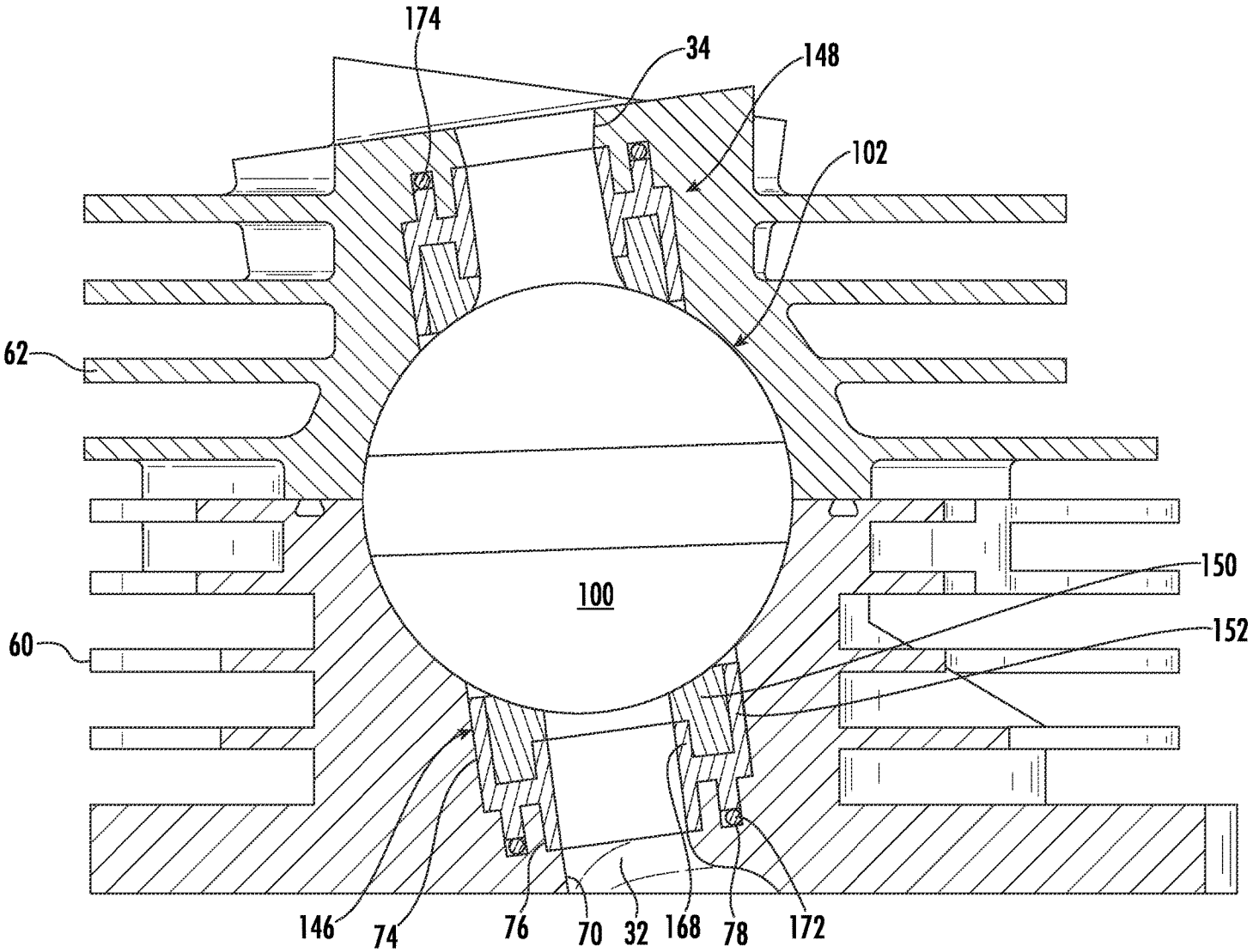
FIG. 15 is a cross-sectional view of a portion of the head assembly of FIG. 2.

As seen in FIG. 15, the secondary seals 172, 174 urge the seal 150 outwards relative to the seal seats 78, 82 and into contact with the peripheral surface 102 of the valve barrel 100. The secondary seals 172, 174 are intended to provide a preload and maintain the seal 150 in the correct assembled position.

Figure 25:
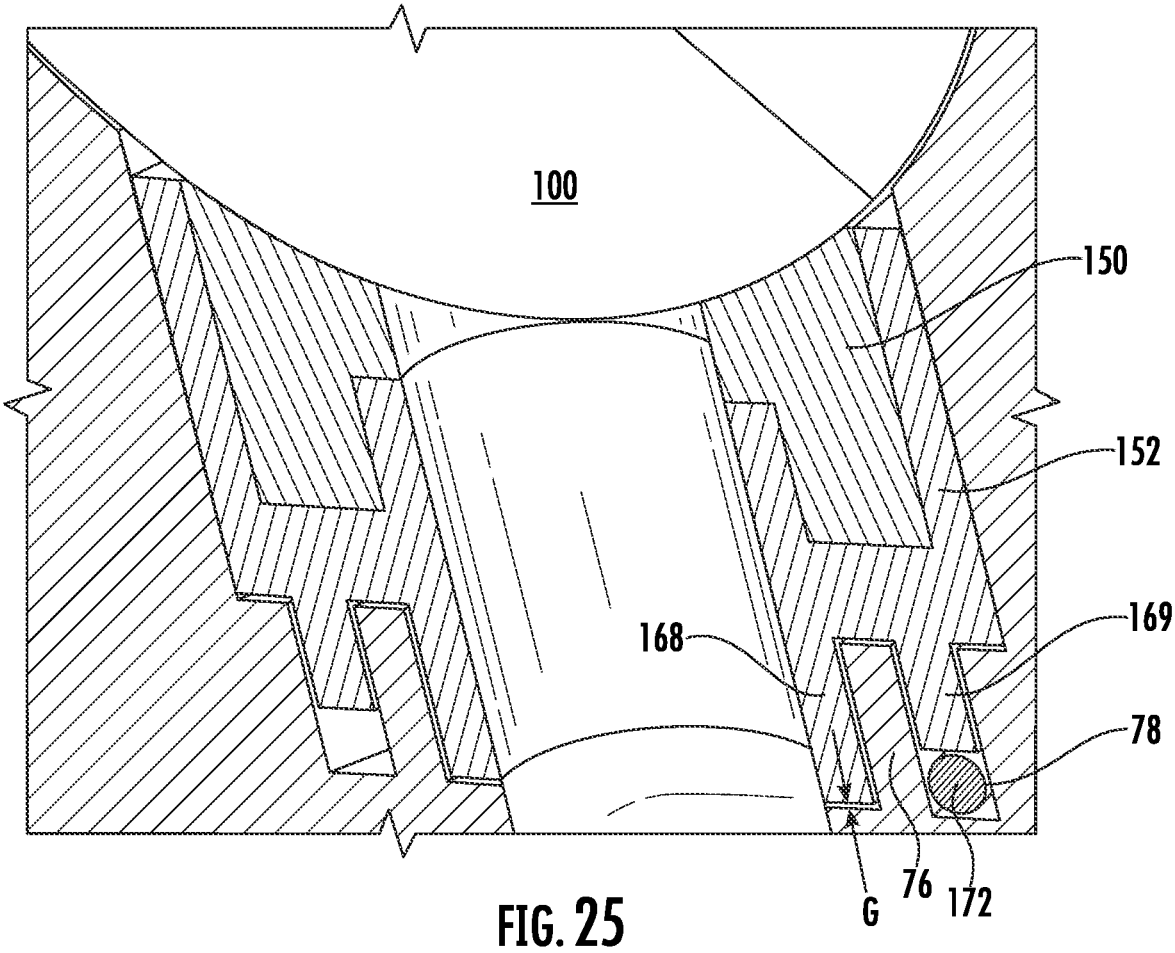
FIG. 25 is an enlarged view of a portion of FIG. 15.

Collectively, the intake tube receptacle 76, intake tube 168, secondary seal flange 169 and intake seal seat 78 define a "labyrinth seal". As used herein the term "labyrinth seal" refers to a sealing interface which includes one or more structural elements such as walls, teeth, or flanges which block a direct line of sight leakage path between two locations. As best seen in FIG. 25, a small gap "G" gap between the shoe 152 and cylinder head 58 allows for the shoe 152 to "float" slightly (and keep in sealing contact with the valve barrel 100) to provide a functional seal. The labyrinth's small air gap G keeps the gases from leaving the combustion chamber through their tight passageways (and the related boundary layer) and the resilient secondary does the final job of sealing the shoe 152 to the cylinder head. In one example, the gap G may be approximately 0.08 mm (0.003 inches).

The small amount of floating movement prevents the sealing interface between the valve barrel 100 and the seal 150 from opening up (during heat expansion, vibration, general operation, etc.), resulting in leaking. The labyrinth seal also serves to protect the resilient secondary seal 172 from direct exposure to combustion gases. This labyrinth seal principle is employed in all of the seal shoes described herein.

Figure 26:
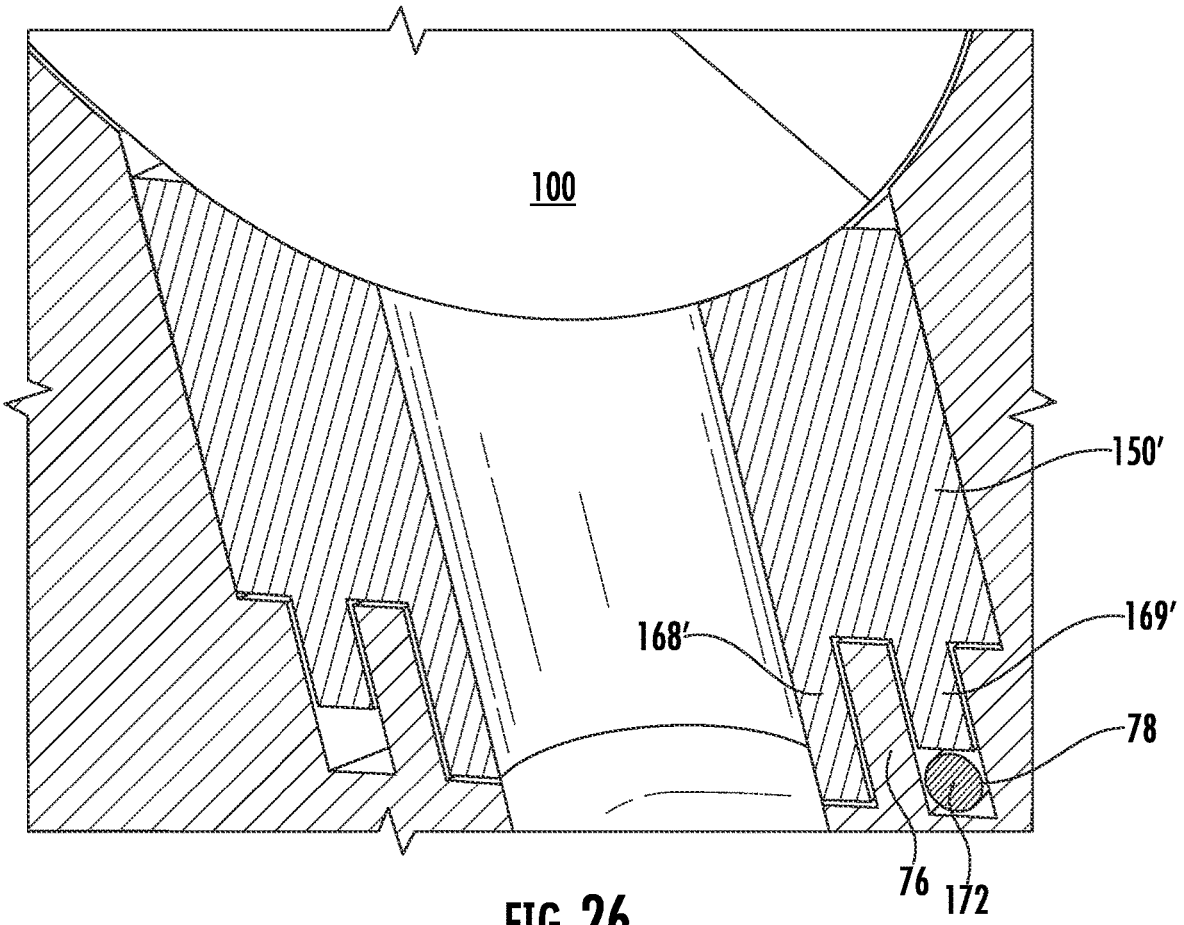
FIG. 26 is a cross-sectional view of a portion of an alternative seal assembly.

In the above embodiments, the sealing assembly has been described as including a seal received in a shoe. This provides a seal with a surface which is conformal to the valve barrel, wear-resistant, and potentially self-lubricating, while the shoe provides structural support for the seal and comprises a ductile structure to define the small mechanical features of the labyrinth seal. Alternatively, the sealing surface and labyrinth seal may be formed as part of a unitary component. FIG. 26 illustrates an example seal 150' which includes a concave sealing surface (lying against valve barrel 100) as well as an integral intake tube 168' and secondary seal flange 169', which define parts of the labyrinth seal. For this configuration the seal would be manufactured from a non-brittle material. One non-limiting example of a suitable material is oil-impregnated bronze.

In the assembled engine, means (not shown) are provided to rotate the valve barrel 100 in synchronization with rotation of the crankshaft 20. The valve barrel 100 is driven by belts, shafts, gear, motors, or other similar drive apparatus. Generally, it would be rotated at one-quarter of the rotational speed of the crankshaft 20. In other embodiments, it can be rotated at other chosen rotational speeds. The exact sequence of opening and closing of the inlet aperture and exhaust aperture will depend upon the specific engine cycle used. One possible example is the conventional Otto cycle.

FIGS. 16-24 illustrate an alternative cylinder head assembly 230 which may be used with the engine 10 instead of the cylinder head assembly 30 described above.

The overall operating principle of the cylinder head assembly 230 is the same as that of the cylinder head assembly 30. The primary differences are that the cylinder head assembly 230 includes two valve barrels and a cylinder head made in three sections.

The cylinder head assembly 230 includes a cylinder head 258 made up of a lower section 260, a center section 261, and an upper section 262.

The lower section 260 is a block-like element which may be formed, for example, by casting or machining from billet. It includes an exterior surface 264 which incorporates a combustion chamber 232 (see FIG. 20), and an opposed interior surface 266. An intake opening 270 and an exhaust opening 272 pass through the lower section 260.

The interior surface 266 includes an intake seal recess 274 surrounding the intake opening 270. Within the intake seal recess 274, an intake tube receptacle 276 surrounds the intake opening 270. A groove-like intake seal seat 278 surrounds the intake tube receptacle 276.

An intake seal assembly 346 (FIG. 21) is received in the intake seal recess 274. It includes an intake seal 350 with an intake passage 360, received in a shoe 352. The shoe 352 incorporates an intake tube 368 (FIG. 24), which is a telescoping fit in the intake tube receptacle 276, and a secondary seal flange 369 surrounding the intake tube 368. A secondary intake seal 372 is disposed in the intake seal seat 278.

The seal 350 may be made from a material as described above for the seal 150.

The shoe 352 may be made from a generally rigid, durable material, such as a metal alloy.

Similarly, the interior surface 266 includes an exhaust seal recess 275 surrounding the exhaust opening 272. Within the exhaust seal recess 275, an exhaust tube receptacle 277 surrounds the exhaust opening 272. A groove-like exhaust seal seat 282 surrounds the exhaust opening 272.

An exhaust seal assembly 345 is received in the exhaust seal recess 275. It includes an exhaust seal 351 with an intake passage 361, received in a shoe 353. The shoe 353 incorporates an exhaust tube 371 (FIG. 24) which is a telescoping fit in the exhaust tube receptacle 277, and a secondary seal flange 373 surrounding the exhaust tube 371. A secondary exhaust seal 375 is disposed in the exhaust seal seat 282.

Figure 24:
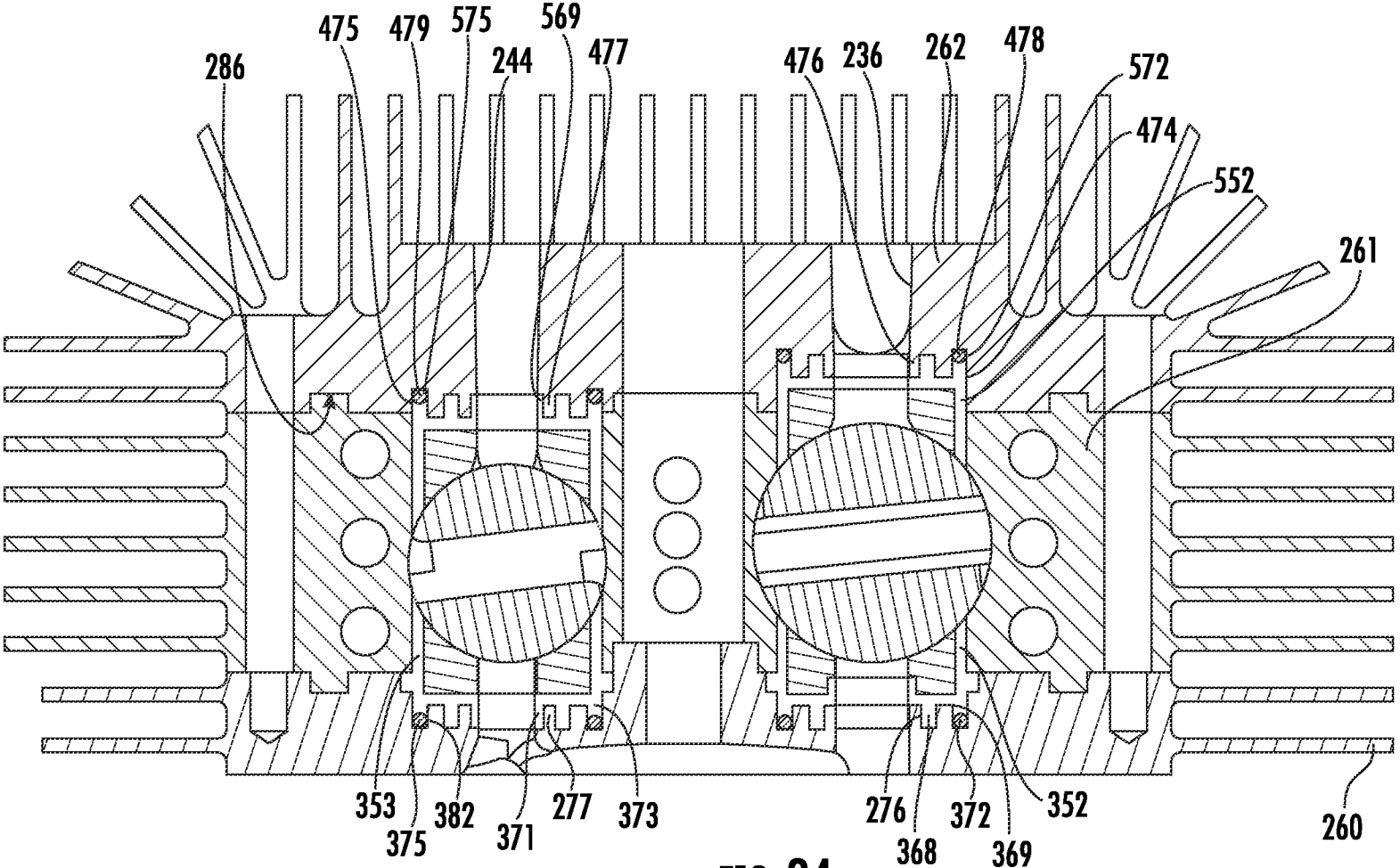
FIG. 24 is a cross-sectional view of a portion of the head assembly of FIG. 2.

The upper section 262 is also a block-like element which may be formed by casting or machining from billet. It includes an exterior surface 284, and an opposed interior surface 286 (FIG. 24). An intake port 236 and exhaust port 244 are formed as part of the upper section 262.

Similar to the lower section 260, the upper section 262 includes an intake seal recess 474, an intake tube receptacle 476, and intake seal seat 478, and an intake seal assembly 546 (FIG. 21) including an intake seal 550 and shoe 552, intake tube 568, secondary seal flange 571, and a secondary intake seal 572 (FIG. 24).

The upper section 262 also includes an exhaust seal recess 475, an exhaust tube receptacle 477, an exhaust seal seat 479, and an exhaust seal assembly 545 (FIG. 21) including an exhaust seal 551 and shoe 553, exhaust tube 569, secondary seal flange 573, and a secondary exhaust seal 575 (FIG. 24).

The center section 261 (FIGS. 17, 18) is also a block-like element which may be formed by casting or machining from billet. It includes a lower surface 285 which mates with the interior surface 266 of the lower section 260, and an opposed upper surface 287 which mates with the interior surface 286 of the upper section 262. The lower surface 285 includes a lower intake passageway 580 which communicates with the intake seal recess 274 of the lower section 260, and a lower exhaust passageway 582 which communicates with the intake seal recess 275 of the lower section 260.

The upper surface 287 includes an upper intake passageway 584 which communicates with the intake seal recess 474 of the upper section 262, and an upper exhaust passageway 586 which communicates with the intake seal recess 475 of the upper section 262.

A cylindrical intake barrel recess 588 passes through the center section 261. A cylindrical exhaust barrel recess 590 passes through the center section 261, parallel to the intake barrel recess 588. The intake barrel recess 588 is open to the intake passageways 580, 584 and the exhaust barrel recess 590 is open to the exhaust passageways 582, 586.

Figure 16:
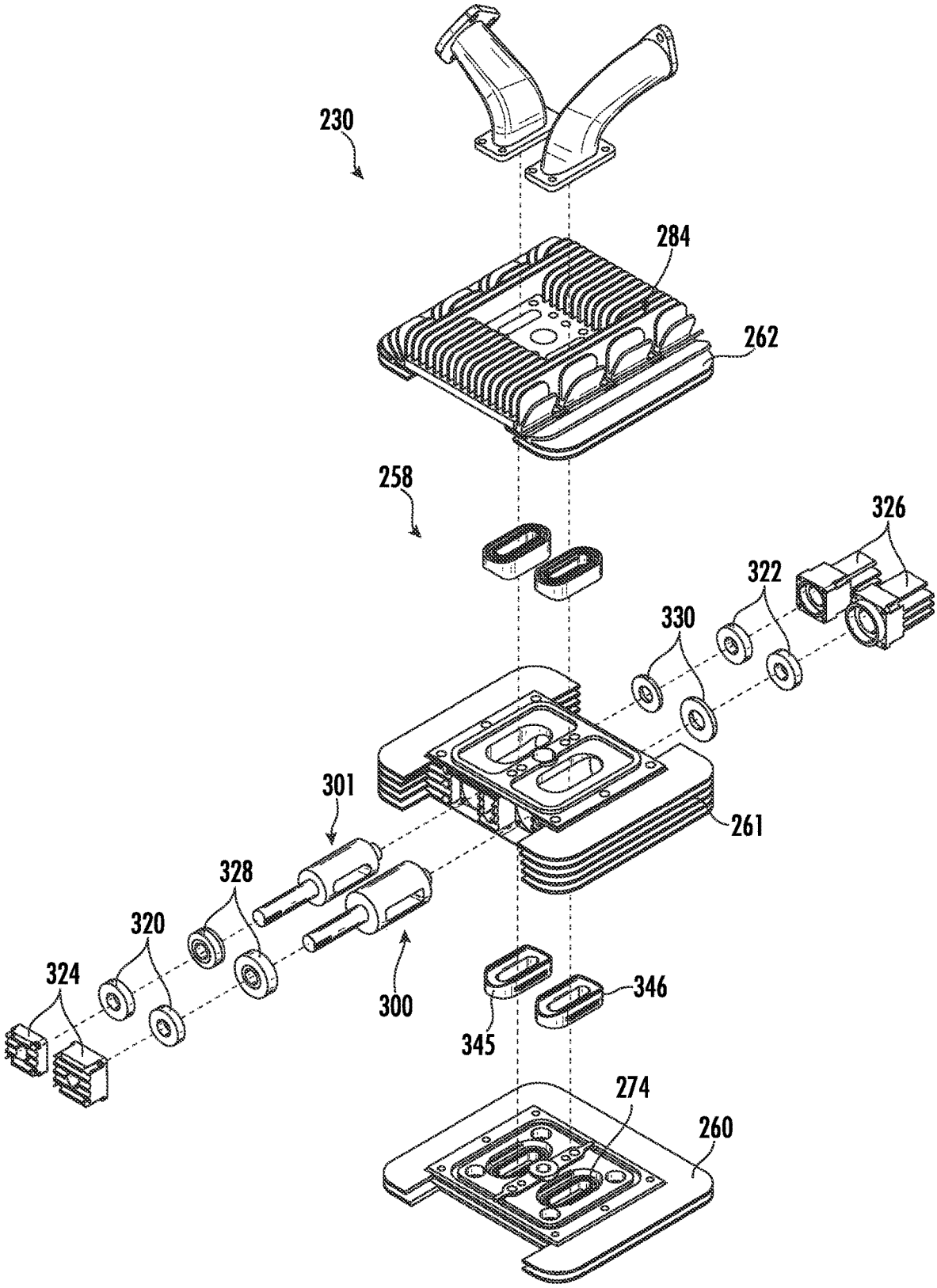
FIG. 16 is an exploded view of a head assembly with rotating valves for an internal combustion engine in accordance with an alternative aspect of the present invention.
Figure 17:
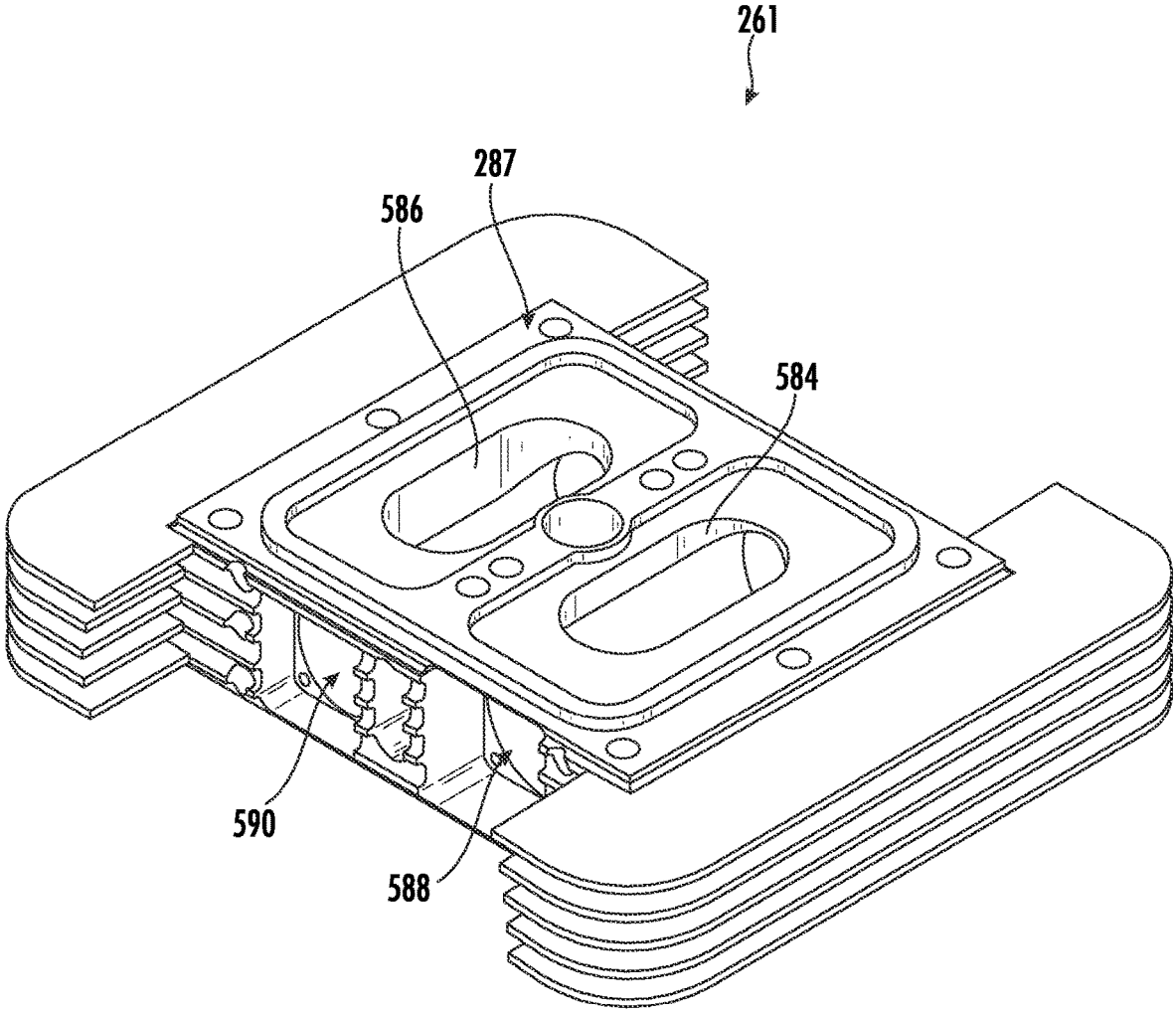
FIG. 17 is an upper perspective view of a center section of the head assembly of FIG. 16.
Figure 18:
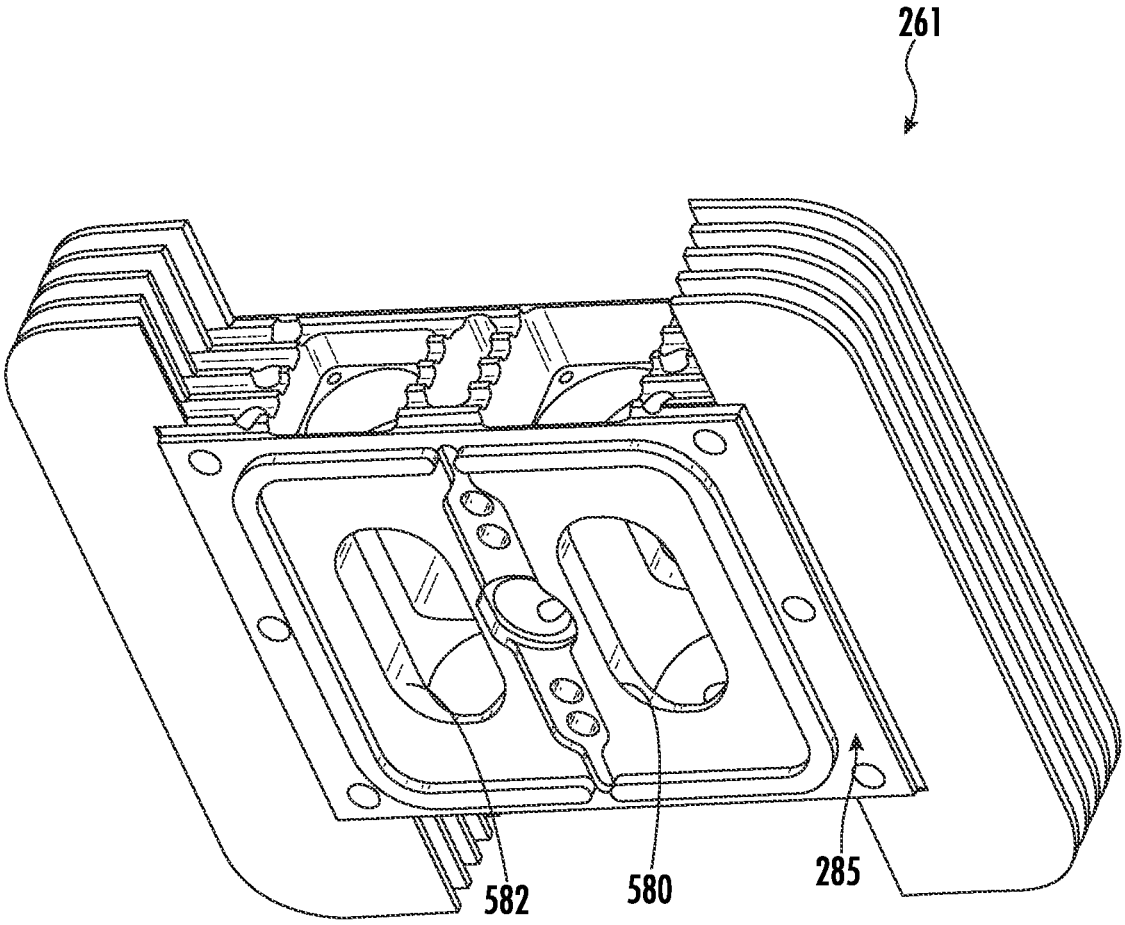
FIG. 18 is a lower perspective view of a center section of the head assembly of FIG. 16.
Figure 19:
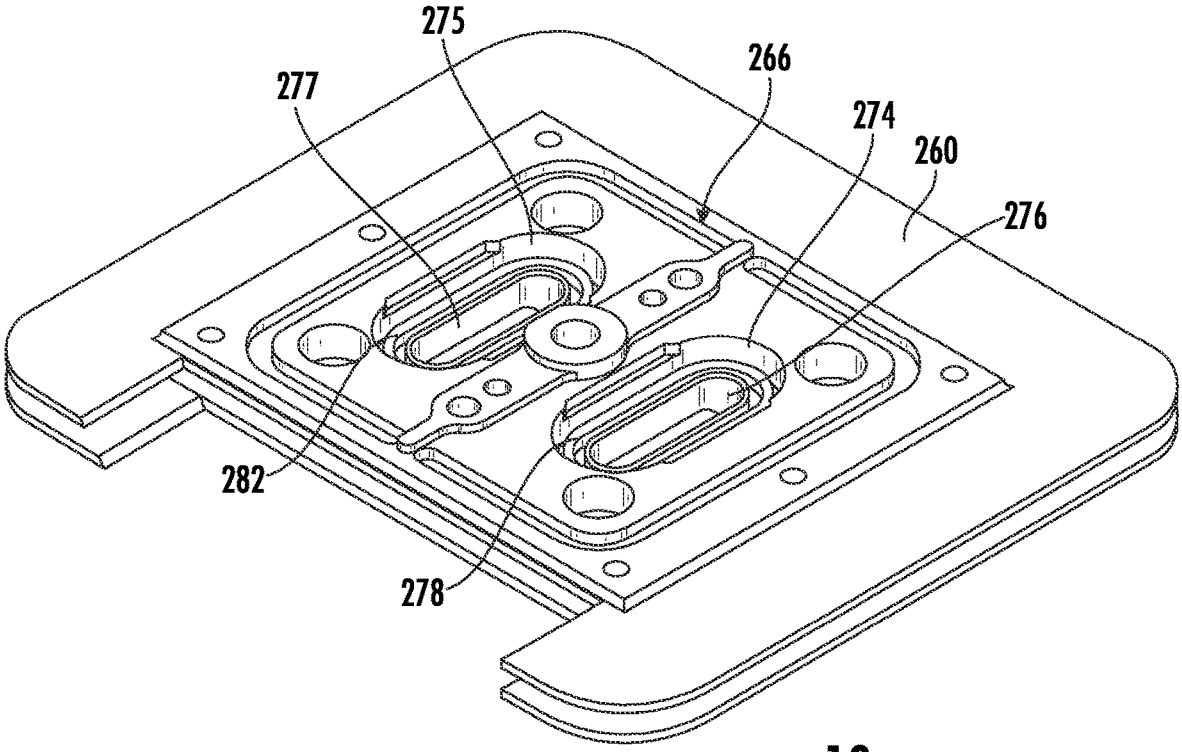
FIG. 19 is an upper perspective view of a lower section of the head assembly of FIG. 16.
Figure 20:
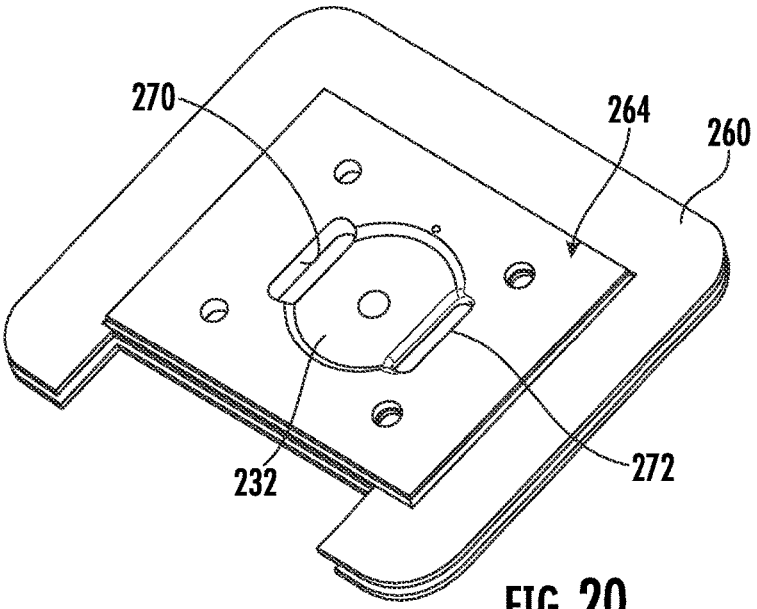
FIG. 20 is a lower perspective view of a lower section of the head assembly of FIG. 16.
Figure 21:
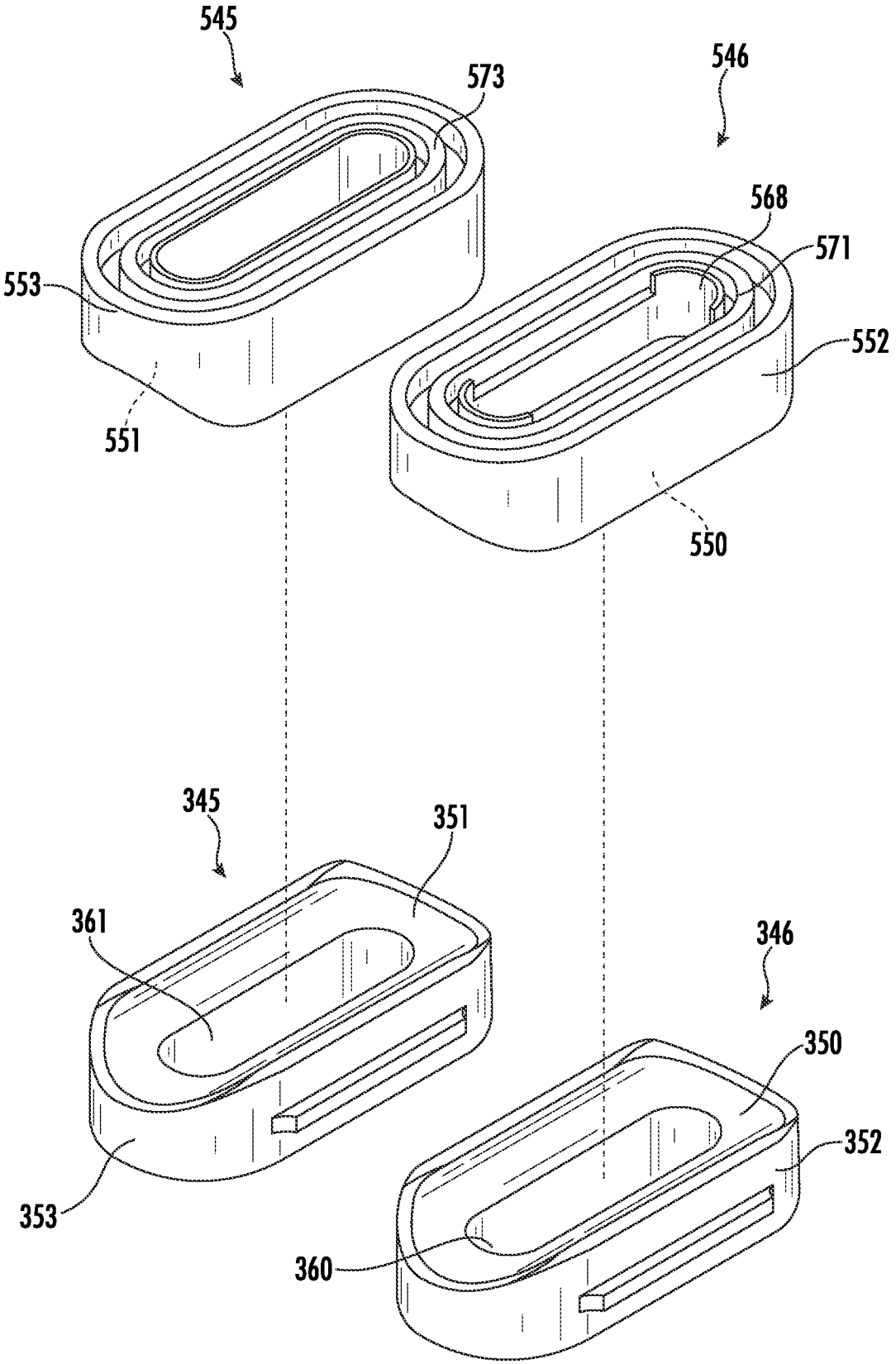
FIG. 21 is a perspective view of seal assemblies of the head assembly of FIG. 16.
Figure 22:
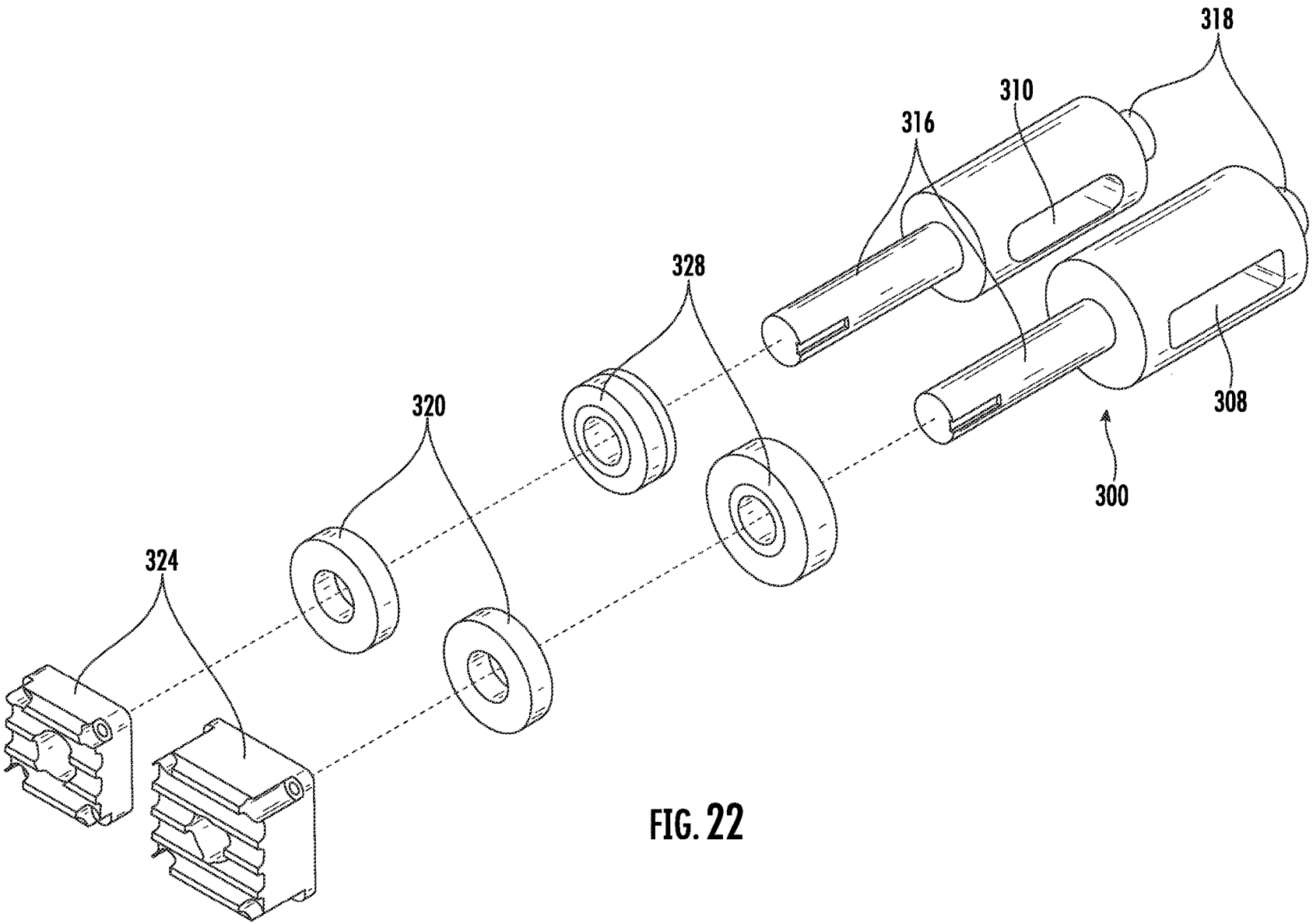
FIG. 22 is an exploded view of the internal components of the head assembly of FIG. 16.
Figure 23:
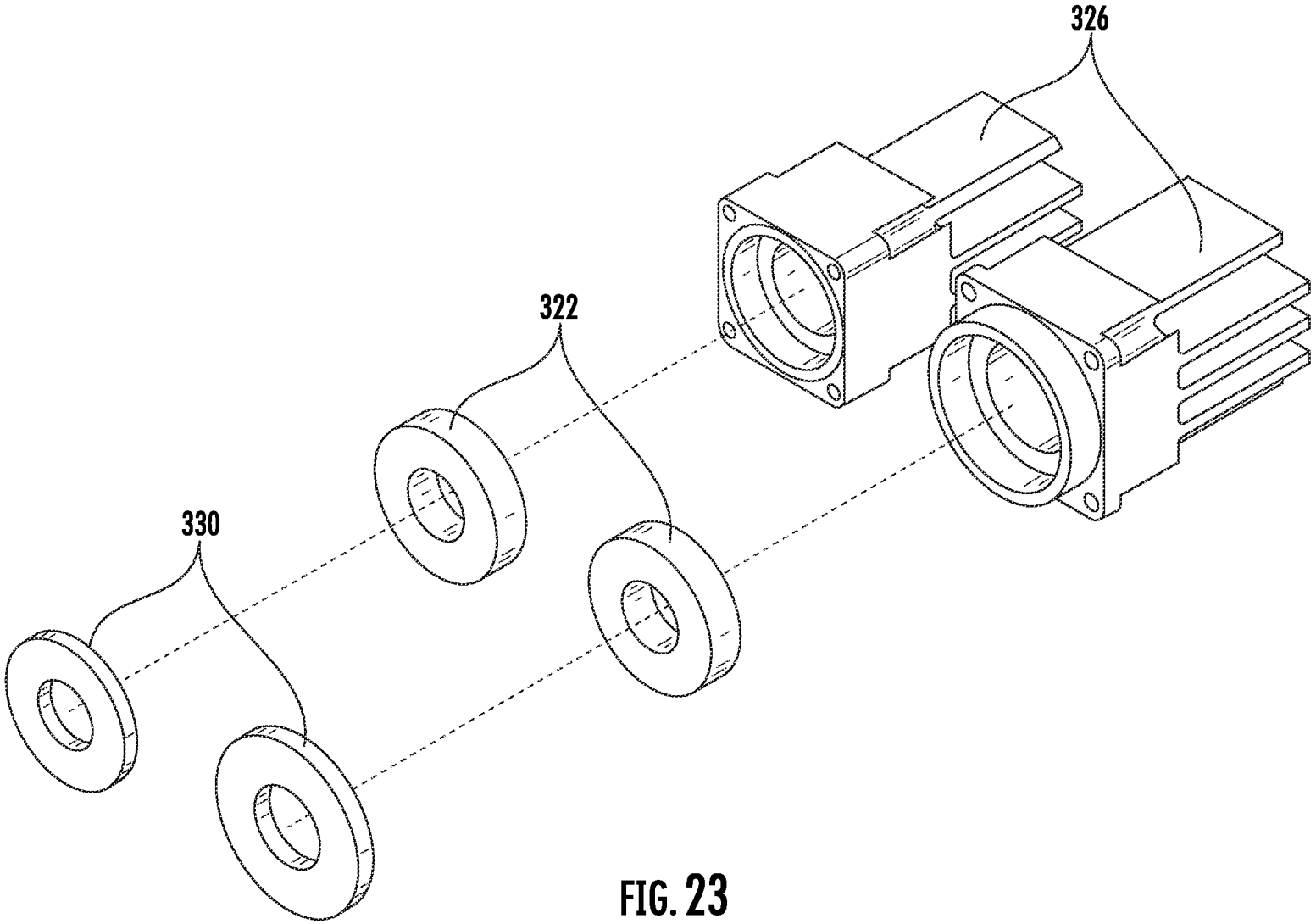
FIG. 23 is another exploded view of the internal components of the head assembly of FIG. 16.

The center section 261 receives rotary valve barrels (or simply "barrels"), specifically, as shown in FIG. 16, an intake valve barrel 300 is disposed in the intake barrel recess 588 and an exhaust valve barrel 301 is disposed in the exhaust barrel recess 590. Referring to FIG. 22, each valve barrel 300, 301 is a generally cylindrical element with an annular peripheral surface extending between forward and aft end faces. An intake aperture 308 extends transversely through the intake valve barrel 300. An exhaust aperture 310 extends transversely through the exhaust valve barrel 301.

Optionally, the edge between the apertures 308, 310 and the respective peripheral surfaces may have a profile such as a bevel, chamfer, radius, or notch for the purpose of manipulating flow characteristics and/or changing the effective opening and/or closing point of the apertures 308, 310.

The valve barrels 300, 301 may be made from a material as described above for the valve barrel 100.

The valve barrels 300, 301 each include a forward stub shaft 316 and an aft stub shaft 318.

The valve barrels 300, 301 are mounted for rotation in the cylinder head 258 (specifically the center section 261) by front bearings 320 (FIG. 16) that receive the forward stub shafts 316 and rear bearings 322 that receive the aft stub shafts 318.

The front bearings 320 are mounted in front caps 324 which are connected to the cylinder head 258 with suitable fasteners (not shown). The rear bearings 322 are mounted in rear caps 326 which are connected to the cylinder head 258 with suitable fasteners (not shown).

The valve barrels 300, 301 are provided with optional front end seals 328 sandwiched between the front bearing 320 and the forward end faces of the valve barrels 300, 301, and optional rear end seals 330 sandwiched between the rear bearings 322 and the aft end faces of the valve barrels 300, 301.

The construction and materials of the end seals 328, 330 may substantially similar to the end seals 128, 130 described above.

The apparatus described above has several advantages over the prior art. The rotary valve structure has significantly lower parts count and frictional losses as compared to a conventional poppet valvetrain. The rotary valve structure also has the potential to be much more reliable than a conventional valvetrain because it does not require reciprocating movement and does not rely on highly-stressed valve springs for operation at high engine speeds.

Furthermore, the sealing assembly described herein will provide effective sealing of the rotary valve apparatus while permitting low mechanical loads and long component life.

It will be understood that the present invention may be implemented as a complete engine, or that the cylinder head assemblies described herein may be retrofitted to an existing internal combustion engine, or that the rotary valve apparatus and/or the sealing assembly may be incorporated into a cylinder head design.

The foregoing has described an engine with rotating valve assembly. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A cylinder head assembly for an internal combustion engine, comprising:

a cylinder head defining a combustion chamber and having at least one opening communicating therewith;

at least one port;

at least one rotatable valve element disposed between the at least one opening and the at least one port; and at least one seal assembly disposed between the at least one rotatable valve element and the cylinder head, the seal assembly comprising a seal having a concave sealing face which conforms to a peripheral surface of the at least one valve element, a labyrinth seal disposed opposite the sealing face, and a resilient secondary seal disposed between the seal and the cylinder head, wherein the seal assembly comprises a seal defining the sealing face disposed inside a shoe which defines the labyrinth seal and wherein the seal includes an aperture and the shoe includes a tube in fluid communication with the aperture.

2. The cylinder head assembly of claim 1 wherein the seal comprises a wear resistant material.

3. The cylinder head assembly of claim 1 wherein the seal comprises a self-lubricating material.

4. The cylinder head assembly of claim 1 wherein the seal comprises carbon.

5. The cylinder head assembly of claim 1 wherein the seal is racetrack-shaped in plan view and includes a back face opposite the sealing face, an inner peripheral face, and an outer peripheral face.

6. The cylinder head assembly of claim 1 wherein the at least one rotatable valve element comprises a metal alloy.

7. The cylinder head assembly of claim 1 wherein the shoe comprises a metal alloy.

8. The cylinder head assembly of claim 1 wherein the secondary seal comprises a nonmetallic material.

9. The cylinder head assembly of claim 1 wherein the shoe includes a secondary seal flange, and the secondary seal is positioned between the secondary seal flange and a seal seat of the cylinder head.

10. The cylinder head assembly of claim 1 wherein the cylinder head comprises an upper section and a lower section, with the first and second rotatable valve elements disposed between the upper and lower sections.

11. The cylinder head assembly of claim 10 wherein the lower section is integrally formed with a cylinder barrel of an engine.

12. The cylinder head assembly of claim 1 wherein the cylinder head is integrally formed with a cylinder barrel of an engine.

13. The cylinder head assembly of claim 1, wherein the cylinder head comprises a lower section, a center section, and an upper section, with the at least one rotatable valve element disposed within the center section.

14. The cylinder head assembly of claim 13 wherein the lower section is integrally formed with a cylinder barrel of an engine.

15. The cylinder head assembly of claim 1 wherein:

the cylinder head includes an intake opening and an exhaust opening communicating with the combustion chamber;

the cylinder head includes an intake port;

the cylinder head includes an exhaust port;

a first rotatable valve element is disposed between the intake opening and the intake port; and a second rotatable valve element is disposed between the exhaust opening and the exhaust port; and the first and second rotatable valve elements are parts of a single valve barrel.

16. The cylinder head assembly of claim 15 wherein:

a first seal assembly is positioned between the valve barrel and the intake and exhaust openings of the cylinder head.

17. The cylinder head assembly of claim 16 wherein:

a second seal assembly is positioned between the valve barrel and the inlet and outlet ports of the cylinder head.

18. The cylinder head assembly of claim 15 wherein the valve barrel and the cylinder head cooperatively define a non-contact rotating seal.

19. The cylinder head assembly of claim 15 wherein:

the valve barrel extends between forward and aft end faces;

a front end seal is disposed adjacent the forward end face, and includes an annular seal tooth which is received in an annular seal groove of the cylinder head; and a rear end seal is disposed adjacent the aft end face, and includes an annular seal tooth which is received in an annular seal groove of the cylinder head.

20. The cylinder head assembly of claim 19 wherein the front end seal and the rear end seal comprise a sintered graphite form of carbon.

21. The cylinder head assembly of claim 1 wherein:

the cylinder head includes an intake opening and an exhaust opening communicating with the combustion chamber;

the cylinder head includes an intake port;

the cylinder head includes an exhaust port;

a first rotatable valve element is disposed between the intake opening and the intake port; and a second rotatable valve element is disposed between the exhaust opening and the exhaust port; and the first rotatable valve element is an intake valve barrel mounted for rotation within the cylinder head; and the second rotatable valve element is an exhaust valve barrel mounted for rotation within the cylinder head.

22. The cylinder head assembly of claim 1 in combination with an engine, wherein the engine includes:

a block defining a cylinder bore, wherein the cylinder bore closes off an end of the cylinder bore;

a crankshaft mounted for rotation in the block;

a piston disposed in the cylinder bore; and a connecting rod interconnecting the piston to the crankshaft.

* * * * *